US006543583B1

(12) United States Patent
Lence Barreiro et al.

(10) Patent No.: US 6,543,583 B1
(45) Date of Patent: Apr. 8, 2003

(54) ELEVATOR AUDITING WITH RECOMMENDED ACTION, REASON AND SEVERITY IN MAINTENANCE MESSAGES

(75) Inventors: Juan A. Lence Barreiro, Santiago de Compostela (ES); Chouhwan Moon, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/899,007

(22) Filed: Jul. 2, 2001

(51) Int. Cl.[7] ..... B66B 1/34; B66B 13/14
(52) U.S. Cl. ..... 187/391; 187/316
(58) Field of Search ..... 187/247, 248, 187/316, 391, 393; 702/179, 182–185; 49/25, 28

(56) References Cited

U.S. PATENT DOCUMENTS 4,727,499 A * 2/1988 Tsuji ..... 187/247
4,750,591 A * 6/1988 Coste et al. ..... 187/391
4,930,604 A * 6/1990 Schienda et al. ..... 187/393
4,936,419 A * 6/1990 Stadler et al. ..... 187/393
5,760,350 A * 6/1998 Pepin et al. ..... 187/316
5,780,787 A * 7/1998 Kamani et al. ..... 187/316
5,787,020 A * 7/1998 Molliere et al. ..... 187/393
5,817,993 A * 10/1998 Kamani et al. ..... 187/316
6,330,935 B1 * 12/2001 Systermans ..... 187/391
6,330,936 B1 * 12/2001 Lence Barreiro et al. ... 187/247
6,392,537 B1 * 5/2002 Tazumi et al. ..... 187/316

* cited by examiner

*Primary Examiner*—Jonathan Salata

(57) ABSTRACT

Information including normal and abnormal operating conditions and events, resulting from operation of elevator car and landing doors, is monitored and recorded (FIGS. 1–28), compared and combined with other information and with thresholds to detect notable events and conditions and generate corresponding messages including a reason for the message, severity of the related event or condition, and optionally, a general maintenance recommendation. The maintenance messages include adjusting or cleaning: car door vane (A–D), landing door lock at a given floor (E–L), car door closed switch (M–R), car door track or sill (S–Y), landing door track or sill (Z–EE), door drive belt (FF, GG), elevator car door motor or door controller mechanism (HH–MM), and car guide rails (FFF); and include adjusting or replacing: door position encoder (NN, OO), between-door safety device (PP–SS), door open/close buttons (TT–XX), landing and car call buttons (YY–AAA) and lights (BBB, CCC), and car rail guides (DDD, EEE).

26 Claims, 22 Drawing Sheets

ELEVATOR AUDITING WITH RECOMMENDED ACTION, REASON AND SEVERITY IN MAINTENANCE MESSAGES

RELATED APPLICATIONS.

Some matter disclosed herein is disclosed and claimed in commonly owned copending U.S. patent application Ser. No. 09/898,853 filed contemporaneously herewith.

TECHNICAL FIELD

This invention relates to auditing events and conditions relating to the operation of elevator car and landing doors to provide maintenance messages indicative of maintenance action which is recommended to be taken, reasons for the recommendation, and indications of the severity of the underlying situation.

BACKGROUND ART

Elevator service known to the art depends primarily on periodic inspections and periodic performance of preventive actions, such as rebuilding subsystems, changing parts that are known to wear out, and the like. However, the periods of time between such inspections and preventive actions is based on average elevator environment, average elevator usage and average elevator maintenance. Therefore, the selected time period bears little relevance to the actual conditions of any particular elevator. In addition, periodic inspections rarely detect existing or impending problems. Periodic preventive actions are wasteful when unnecessary.

Prior elevator maintenance and repair has heretofore been based on very little information, depending instead on the intuition of service personnel which in turn depends substantially on the experience level of the service personnel. Service personnel must first determine the likely source of a problem and then make a subjective decision about what, if any, action is to be taken.

In the prior art, there is little if any assistance in detecting intermittent problems. When a problem has occurred but the elevator is running on arrival of the service personnel, the problem will not then be apparent to the service personnel. Maintenance recommendation messages provided by prior art maintenance systems have typically been very general, such as "problem closing door" or "problem opening door".

DISCLOSURE OF INVENTION

Objects of the invention include: providing elevator door service and maintenance based upon factual information, including both performance and failure information, relative to the landing and car doors of a specific elevator; reducing reliance on periodic inspection and periodic preventive action for elevator door-related maintenance; providing necessary elevator door-related maintenance while reducing unnecessary maintenance activities; eliminating reliance on subjective intuition of service personnel in maintaining and servicing elevator doors; reducing reliance on experience of service personnel in maintaining and servicing elevator doors; finding the origin of elevator door problems quickly; restoring elevator service faster after having door problems; detecting the cause of intermittent elevator door problems; providing information allowing the identification of obscure elevator door problems; and permitting corrective action to be taken even when the elevator is running on arrival of service personnel.

According to the present invention, performance and failure information relative to the landing doors and car door of an elevator is extracted, stored and analyzed to provide sets of recommended maintenance actions and problem resolution service actions.

According to the present invention, operating speeds, operating times, positions, events, discrete conditions, durations, and numbers of occurrences, are monitored and stored, and the information is logically combined, accumulated, averaged, compared against specific corresponding threshold values, and so forth, to determine when notable events have occurred and to identify the nature thereof, which then determines maintenance messages that include reasons for a recommendation, and may include an indication of the severity of the related condition, or a direction to perform some step; such messages may include recommended maintenance and/or service actions which should be taken.

Conditions and events revealed by the invention include: the car door closed sensor or landing door lock switches operating at wrong door positions or conditions; door lock switches rebounding; duration, frequency or number of operations of door open and close buttons, call buttons and a between-door safety device; doors opening or closing fully, or not; door speeds and door operating time; door retrocession; impediments to door movement; condition of door-driving belt or other flexible loop; doors opening without a door open command; activity and duration of operation of between-door safety device, door open and close buttons, and call buttons and lights; and car guide rail and rail guide positioning.

The invention provides an electronic elevator door-related maintenance record that shows the level of maintenance quality. The invention enables establishing relevant elevator door-related maintenance programs based on actual conditions of each elevator.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1—speeds and positions relating to the door lock switch and the door lock switch being bypassed;

FIG. 2—the door lock switch failing, being opened or closed, and being open without a command;

FIG. 3—speed relating to the landing door lock closure, and landing door lock rebounds;

FIG. 4—positions relating to the car door closed switch, and the car door closed switch being bypassed;

FIGS. 5, 6—the car door closed switch being closed, failing, and open without a command, and a car switch problem position;

FIG. 7—door opening time and mode;

FIG. 8—door closing time and mode;

FIG. 9—opening and closing retrocession distance and door state;

FIG. 10—pulse widths, opening pulse number and car door position error; and

FIGS. 11 and 12—opening obstacles, severity and position.

FIG. 14—closing obstacles, severity and position;

FIG. 15—car door open and closed position and opening and closing speeds;

FIG. 16—passengers interacting with the door being likely or unlikely;

FIG. 17—operation and duration of a door safety device;

FIG. 18—operation and duration of a door open button;

FIG. 19—operation and duration of a door close button;

FIG. 20—operation and duration of hall call buttons;

FIG. 21—operation and duration of car call buttons;

FIG. 22—operation and duration of hall call lights;

FIG. 23—operation and duration of car call lights;

FIG. 24—door reversals; and

FIG. 25—total distance traveled by the car.

MODE(S) FOR CARRYING OUT THE INVENTION

Figure 1:
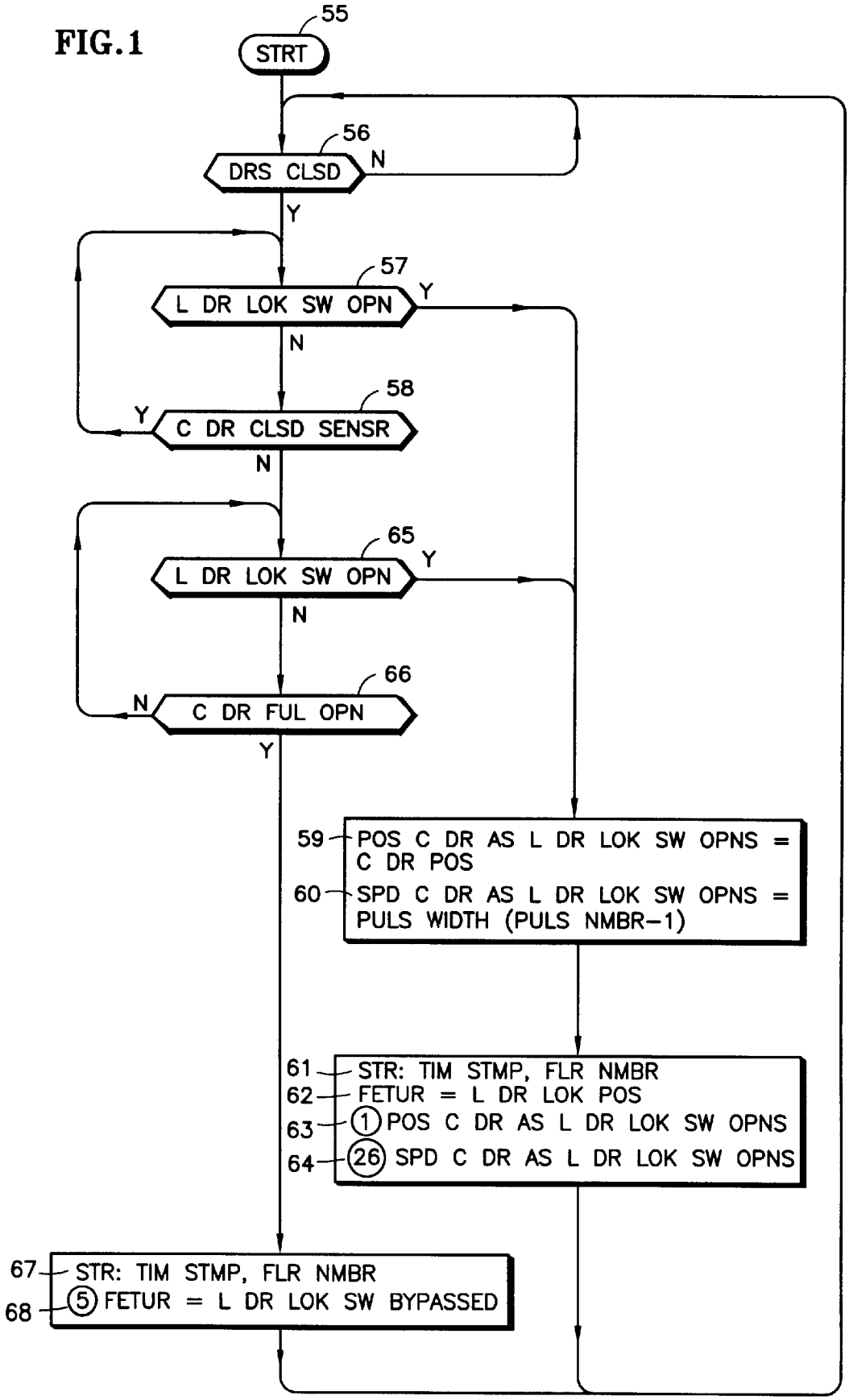
FIGS. 1–12 are logic flow diagrams related to various parameters and features as follows.

Referring to FIG. 1, a routine that generates information about the landing door lock switch is reached through a start entry point 55 and the program waits at a first test 56 until the car door and the landing door are both closed; then a test 57 determines if the landing door lock switch is open. With the door closed, the landing door lock switch will initially not be open, so a test 58 determines if the car door closed sensor is operated. The routine will cycle between tests 57 and 58 until either the landing door lock switch opens or the car door closed sensor no longer senses that the car door is closed. If the landing door lock switch opens first, an affirmative result of test 57 leads to a step 59 where the position of the car door as the landing door lock switch opens is set equal to the car door position, which is provided by a car door position sensor of a conventional type. In a step 60, the speed of the car door as the landing door lock switch opens is set equal to the pulse width of the pulse from the door position encoder which is one pulse ahead of the current pulse. Then a pair of steps 61, 62 store the time stamp (present real time) and floor number (where the car is at this instant), and the feature, which is a way of identifying an event or occurrence of a particular nature; in this case the feature is referred to as "landing door lock position". In the embodiment described herein, a "feature" may be an actual parameter used in the method of auditing and method of maintenance of the invention, or it may simply be the signaling of the event which may be used in processing to achieve the methods of the invention. In this case, the feature, landing door lock position, may be used as an indication that parameters 1 and 26 should be examined. In the drawing, parameter numbers are provided within circles. Some parameters such as Parameter No. 11, the number of car door operations, are obtained in a trivial fashion and therefore are not shown as described. Then step 63 stores Parameter No. 1, the position of the car door as the landing door lock switch opens, and step 64 stores Parameter No. 26, the speed of the car door as the landing door lock switch opens.

If in test 58, the car door closed position sensor no longer senses that the car door is closed, before test 57 determines that the landing door lock switch is open, a test 65 determines if the landing door lock switch is open; initially it will not be so a test 66 determines if the car door is fully open. Initially the car door will not be fully open, so a negative result of test 66 will cause the routine to loop through test 65 and test 66 until either the landing door lock switch is fully open, which is the usual case, or the car door becomes fully open without the landing door lock switch opening, which is a remarkable event. If the landing door lock switch opens, the steps 59–64 are performed as described hereinbefore. But if the car door becomes fully open while the landing door lock switch is not open, an affirmative result of test 66 reaches steps 67 and 68 to store the time stamp and floor number and to store Parameter No. 5, a feature called "landing door lock switch bypassed". This feature indicates either that the switch is jammed in a closed position, or that a technician may have placed jumper leads across the switch, or that the switch may appear to be closed due to conductivity of dust or other debris. In this case the feature is an event which is also a parameter. Note that some parameters are expressed differently in the text from the expression in the drawing: Parameter No. 5 is also referred to as "the landing door lock switch being closed when the landing door is open". However, identity is established through the parameter numbers.

Figure 2:
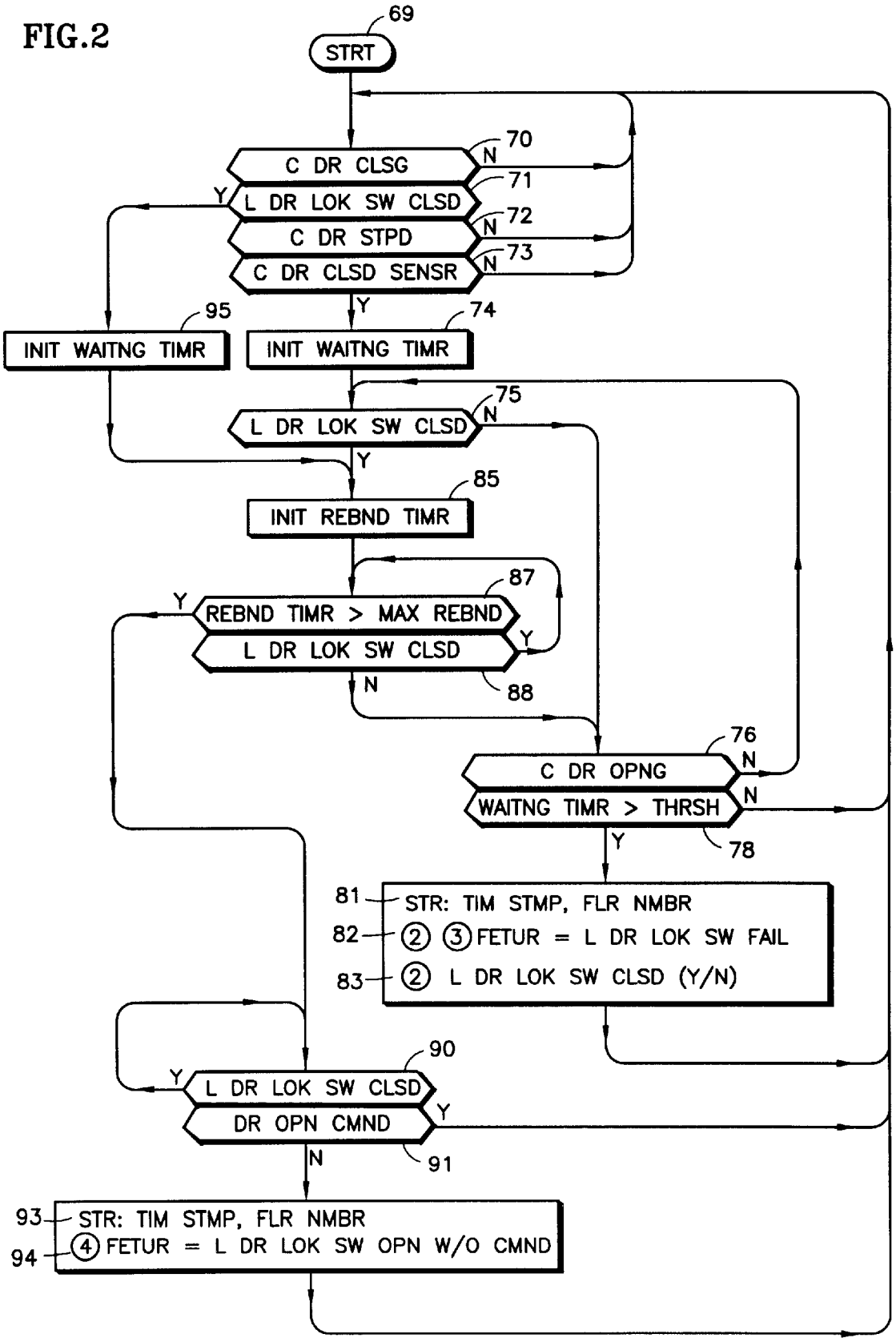

In FIG. 2, another routine relating to the landing door lock switch is reached through a start entry point 69 and the routine waits at a first test 70 until the car door begins to close. Then a test 71 determines if the landing door lock switch is closed. Initially, it will not be so a test 72 will determine if the car door has stopped, and the routine will cycle through steps 70, 71 and 72 until the car door is stopped. When the car door stops, a test 73 determines if the car door closed sensor has actuated, and if not, the routine will cycle through the tests 70–73 until the car door close sensor is actuated by the car door becoming closed. When the car door is closed, a waiting timer is initiated in a step 74 and a test 75 determines if the landing door lock switch is closed; assume for now that it is not, then a test 76 will determine if the car door is opening. With the car door closed sensor just having been actuated, test 76 will usually be initially negative cycling back through test 75 until either the door lock switch becomes closed or the car door begins to open. If the car door begins to open, then a test 78 determines if the waiting timer, which was initiated in step 74, has advanced past a threshold or not. If not, it probably means that the landing door lock switch did not close because the car door began to open as soon as it was closed. Thus, a negative result of test 78 causes the routine to revert to the test 70. But after the waiting timer exceeds a threshold amount of time, which may be on the order of two or three seconds, an affirmative result of test 78 will reach a series of steps 81–83 which store the time stamp and floor number, the feature "landing door lock switch failure" which is a combination of Parameter No. 2, the landing door lock switch not closing and Parameter No. 3, landing door lock switch closed (indicating yes or no, as to whether it is or not). Then the program reverts to step 70 as described hereinbefore.

If the landing door lock switch had closed as soon as the car door closed sensor had been activated, then an affirmative result of test 75 would have reached a step 85 to initiate a rebound timer. Then a test 87 determines if the rebound timer has exceeded a maximum rebound time limit, or not. Initially it will not, so a negative result of test 87 reaches a test 88 to determine if the landing door lock switch is closed or not. If it remains closed, then the routine loops between tests 87 and 88 until the rebound timer times out. But, if the door switch does not remain closed before the rebound timer times out, then a negative result of test 88 will reach test 76, and the routine will proceed as described hereinbefore. On the other hand, if the switch remains closed until after the rebound timer times out, that means that the switch did not rebound into the open state, and an affirmative result of test 87 will reach a test 90 to see if the landing door lock switch remains closed. In the usual case, it will until the landing door reopens. When the test 90 indicates that the landing door lock switch is no longer closed, then a test 91 determines if there has been a door open command; if there has, this indicates normal operation and the routine reverts to test 70 to await the door closing once again. On the other hand, if the door lock switch does not remain closed and there is no door open command, then a negative result of test 91 reaches a pair of steps 93, 94 to store the time stamp and floor number and to store Parameter No. 4, the feature called landing door lock switch open without command. Assume that the routine reaches tests 76 and 78 and the waiting timer has not timed out. A negative result of test 78 will return the routine to test 70, and if the car door is closing, will reach tests 71–73, depending on conditions. If test 71 is positive, then a step 95 will initiate the waiting timer and all of the other tests and steps 72–75 are bypassed. The routine is thereafter as described hereinbefore, beginning with step 85 which initiates the rebound timer.

Figure 3:
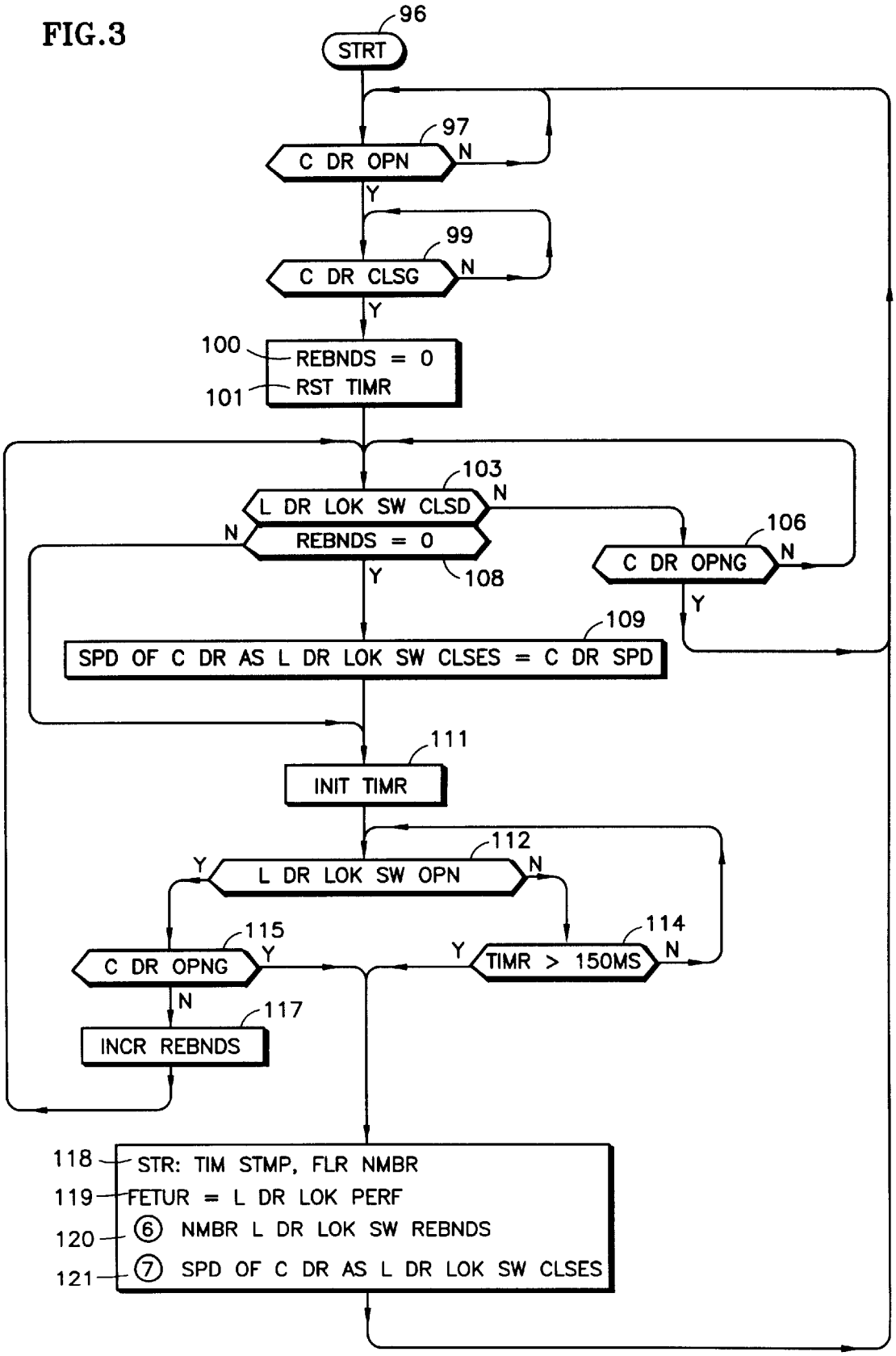

In FIG. 3, a routine which monitors door lock switch rebounds and speed as the door lock closes, is reached through a start entry point 96 and the routine will wait at a test 97 until the car door is open. Then the routine will wait at a test 99 until the car door is closing, after which a step 100 sets a rebound counter equal to zero and a step 101 resets a timer used in this routine. Then a test 103 determines if the landing door lock switch is closed; if not, a test 106 determines if the car door is opening; if neither is happening, the routine waits, looping through tests 103 and 106 until either the landing door lock switch becomes closed or the car door is opening. When the landing door lock switch becomes closed, a test 108 determines if the rebound counter is still at zero or not. If so, a step 109 sets the speed of the car door as the landing door lock switch closes equal to car door speed. A step 111 initiates a timer; note that a "timer" in one routine is not related to a "timer" in another routine. Then a test 112 determines if the landing door lock switch is open; if not, a test 114 determines if the timer has passed 150 milliseconds or not. Until either the landing door lock switch becomes open or the timer exceeds 150 milliseconds, the routine will loop between tests 112 and 114. If the landing door lock switch opens, a test 115 determines if the car door is opening; if not, this means that the landing door lock switch has rebounded into the open condition after having been closed (test 103 followed by test 112). In that case, a step 117 increments the rebounds counter and the routine reverts to test 103. On the other hand, if the landing door lock switch becomes open so that test 112 is affirmative because the car door is opening, test 115 is affirmative and a series of steps 118–121 store the time stamp and the floor number, and a feature called "landing door lock performance", along with Parameter No. 6, the number of landing door lock switch rebounds, and Parameter No. 7, the speed of the car door as the landing door lock switch closes. The feature, landing door lock performance, is not used as a parameter but may be used to trigger examination of parameters 6 or 7.

Figure 4:
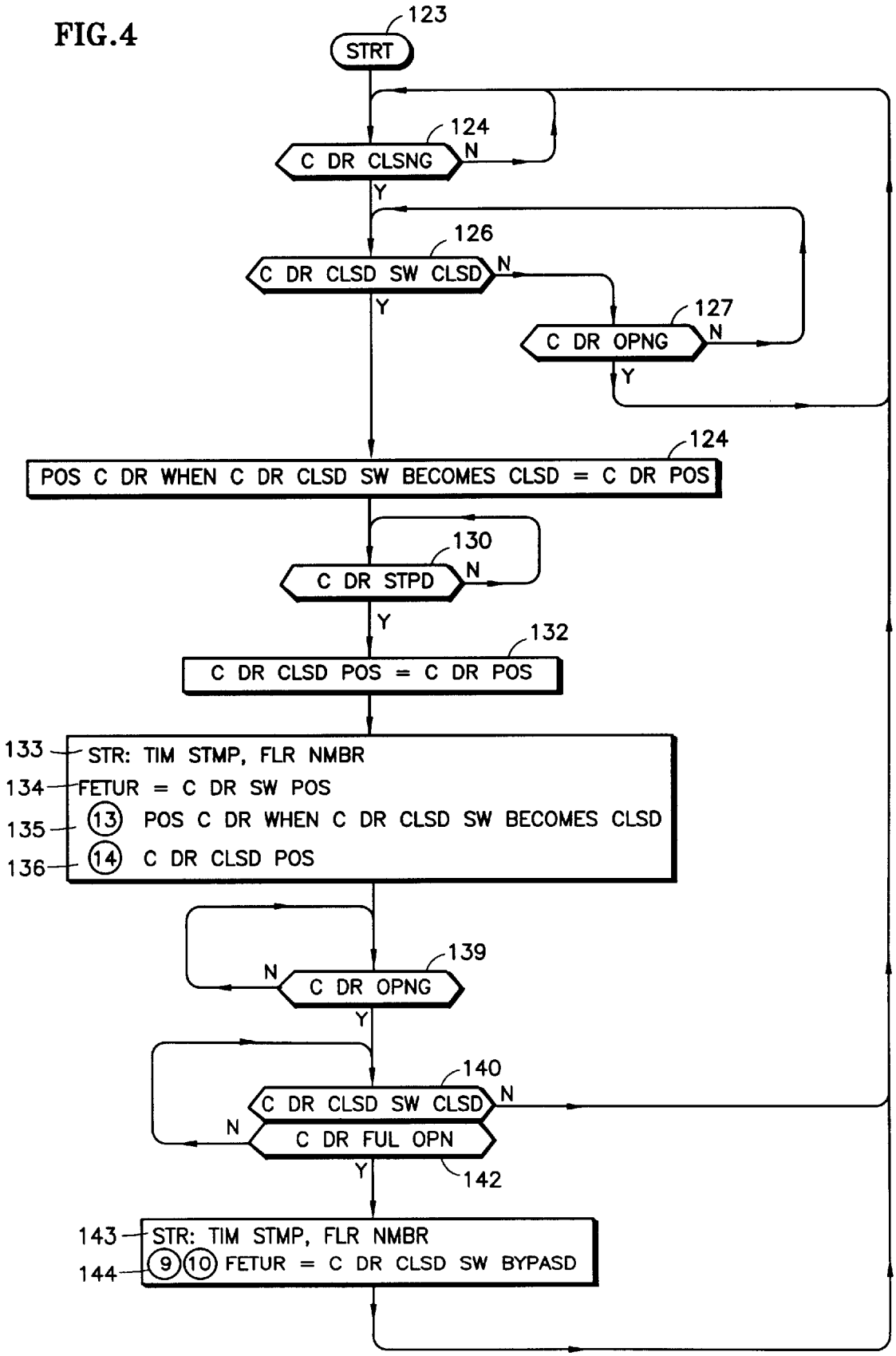

Referring to FIG. 4, a routine that determines closure of the car door closed switch, the car door closed position, and whether the car door closed switch is bypassed, is reached through a start entry point 123. A first test 124 causes the routine to wait until the car door is closing. Then a test 126 determines if the car door closed switch is closed; if not, a test 127 determines if the car door may be opening, which happens when passengers press a hall call button or a door open button, or activate a between door safety device. The routine will revert to test 124 if the car door is opening. Assuming the car door closed switch becomes closed, a step 129 sets the value of the position of the car door when the car door closed switch becomes closed equal to the present car door position. Then the routine waits at a test 130 until the car door becomes stopped. A step 132 then sets the car door closed position equal to the present car door position. A series of steps 133–136 store the time stamp and floor number, and the feature known as car door switch position. This feature is not used as a parameter but may be used for control purposes. Parameter No. 13, position of car door when car door closed switch becomes closed, and Parameter No. 14, the car door closed position, are also stored. The routine then waits at a test 139 until the car door is opening. When the car door is opening, the car door closed switch should no longer be closed. So in the normal case, a negative result of a test 140 causes the routine to revert to the start state at test 124. However, if the car door switch remains closed when the car door is opening, an affirmative result of test 140 reaches a test 142 to cause the program to cycle through both tests until the car door is fully open. Then a pair of steps 143, 144 store the time stamp, floor number and the feature known as "car door closed switch bypassed", which is a combination of Parameters Nos. 9 and 10, and indicates that the door closed switch is short circuited, or that lint or other debris are conducting across the switch's open contacts.

Figure 5:
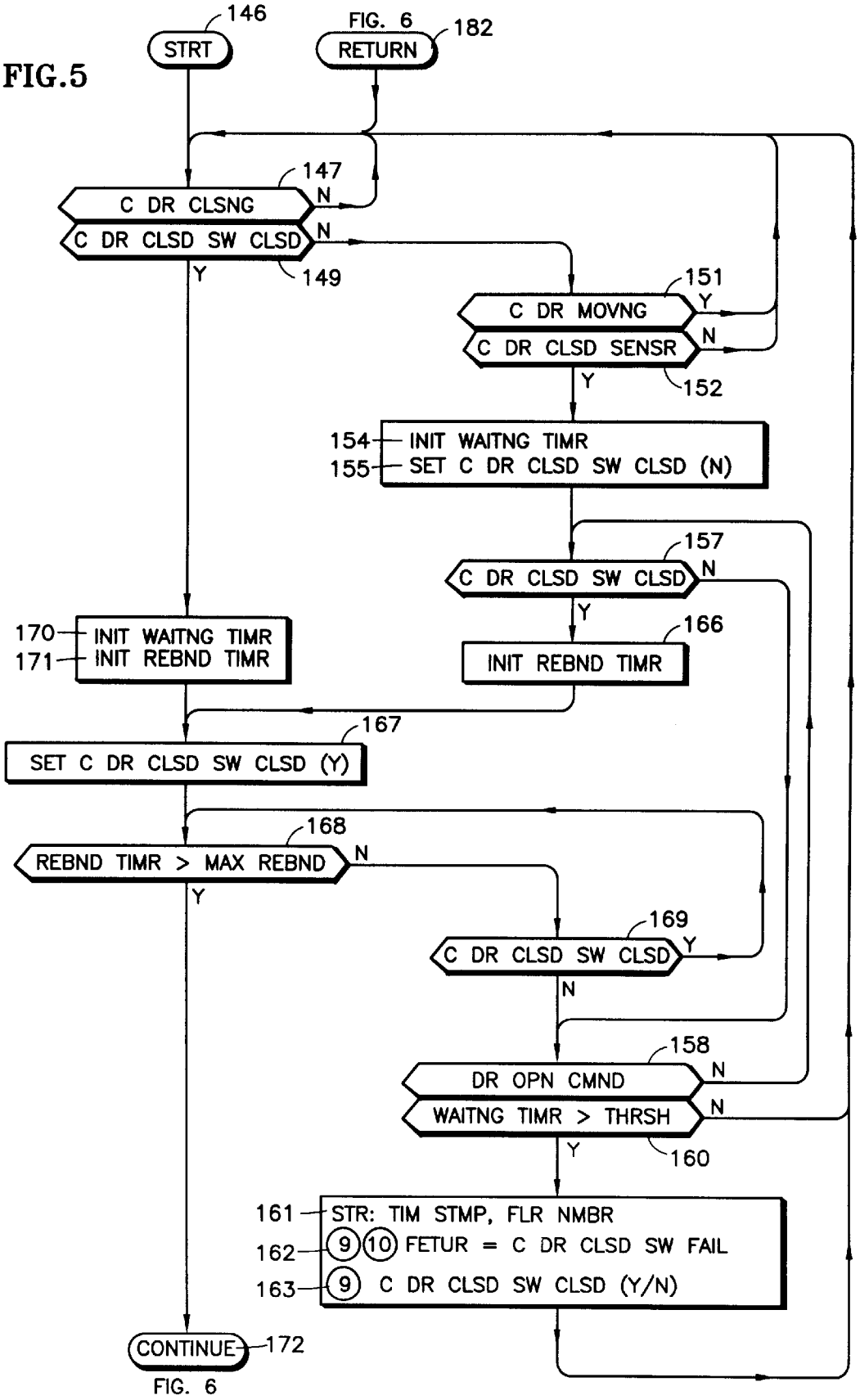
Figure 6:
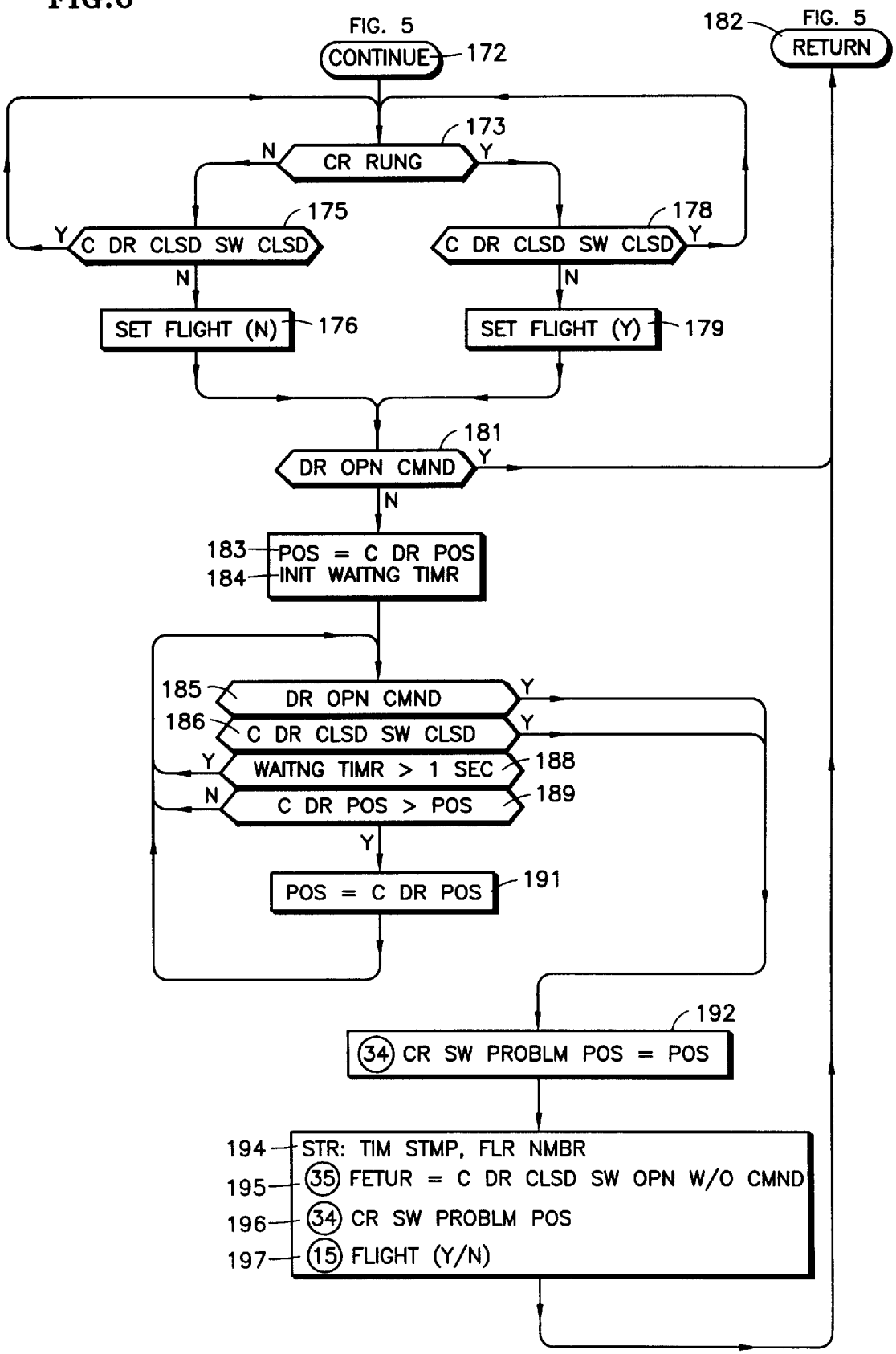

Referring to FIGS. 5 and 6, a routine which tests the car door closed switch for failure and for opening without a command is reached through a start entry point 146 and the routine then waits at a test 147 until the car door is closing. When the car door is closing, a test 149 determines if the car door closed switch is closed or not. Initially, the switch normally will not be closed when the car door begins closing, so a negative result of test 149 reaches a test 151 to determine if the car is moving. If the car is moving, the routine reverts to the start state at test 147. Normally, the car will not be moving so a negative result of test 151 reaches a test 152 to determine if the car door closed sensor is activated. In the usual case, it will not initially be activated so the program will revert to test 147 and cycle through tests 147, 151 and 152 until the car door closed sensor is actuated. When that happens, there is a potential switch failure, as described more fully hereinafter. A step 154 initiates a waiting timer and a step 155 sets the car door closed switch closed indicator to "no". A test 157 determines if the car door closed switch has closed yet or not; if not, a test 158 determines if there has been a door open command. The routine will cycle between tests 157 and 158 until either the car door closed switch becomes closed or there is a door open command. The door open command signals the end of any possibility of the car door closed switch becoming closed. A test 160 determines if a waiting timer has exceeded a threshold, such as on the order of two or three seconds. If not, this means that the failure of the car door closed switch to close is not a notable event so a negative result of test 160 causes the routine to revert to the start state at test 146. But if the timer has timed out, this means that there is a failure of the car door closed switch to close, so a series of steps 161–163 store the time stamp and floor number, and the feature named "car door closed switch failure", which is made up of Parameter Nos. 9 and 10; Parameter No. 9, car door closed switch closed (yes or no) is also stored. And then the program reverts to the start state at test 147. In a normal course of events, as the car door is closing (test 147 affirmative) the routine will pass through the steps and tests 149–155 and reach test 157 (perhaps passing through test 158 once or twice) and eventually the car door closed switch will be closed. Then a step 166 initiates the rebound timer (this is a different rebound timer than the one utilized in FIG. 2) and a step 167 will set the indicator for the car door closed switch closed to "yes". A test 168 determines if the rebound timer has timed out or not, to be sure that the car door closed switch will remain closed. The routine will cycle between tests 168 and 169 until the rebound timer times out or the car door closed switch becomes open. In that event, the routine will proceed from test 158, as described hereinbefore. Assuming the rebound timer times out with the car door closed switch still closed, an affirmative result of test 169 reaches a "continue" transfer point 172 to reach additional portions of the routine set forth on FIG. 6.

Initially, test 149 is negative; but if the door is moving test 151 is positive, leading back to tests 147 and 149. In a normal case, the car door closed switch will close before the door stops, so test 149 will then reach steps 170 and 171 which initiate the waiting and rebound timers. Then, the routine operates as described hereinbefore.

Referring to FIG. 6, the car door switch routine is continued through the transfer point 172. A test 173 determines if the car is running; if not, a test 175 determines if the car door closed switch is closed or not. In the usual case, since this part of the program is reached only from test 149 or test 157 being affirmative, test 175 will usually be affirmative. But if the car door opens at a landing, then a negative result of test 175 will reach a test 176 to set the in-flight indicator to "no", because test 173 found the car was not running. On the other hand, if the car is running, then a negative result of test 178 will reach a step 179 to set the in flight indicator to "yes". If the door opens with the car at a landing or in flight within the door zone, it may well be a normal opening in response to a door open command. Therefore, an affirmative result of a test 181 will cause the routine to return through the transfer point 182 to the start state in FIG. 5. But if the car door switch is not closed, and there is no door open command, then that is a notable event, and a step 183 sets a position value equal to the car door position and a step 184 initiates a waiting timer. Then a test 185 determines if there is a door open command; at this stage of the routine, there initially will not be, so a negative result of test 185 reaches a test 186 to see if the car door closed switch is closed; since this part of the routine is reached from a negative result of test 175 or 178, initially the car door closed switch will not be closed, thereby reaching a test 188 to see if the waiting timer has passed one second yet. Initially, since it was set in step 184, it will not have passed one second. In this embodiment, low values of door position are toward the door being closed, and high values toward open. A test 189 checks if the present car door position is greater than the position value, which it will be if the car door is still opening, thereby indicating a door-open problem. An affirmative result of test 189 reaches a step 199 to update the position value to the present car door position. Then the routine reverts to the test 185 and 186 to see if either there is a door open command or the car door closed switch has finally closed. So long as neither of these occur, the routine will cycle through tests and steps 185 through 188. Once test 188 is affirmative, the car door position is no longer updated. If the car door is closed, and the problem is in the switch, then the position will not be less than the car door position and no updating occurs in step 191. Similarly, if the car door stops, then the position is no longer updated. The position of the car door, whether it be because the car door has stopped or whether it be because the one second has timed out, gives an indication of whether the problem is in the switch or the door mechanism. Eventually, there will either be a door open command or the car door closed switch will become closed (for instance if the car door had been opened by a passenger and now is allowed to close again) so an affirmative result of one of the tests 185, 186 will lead to a step 192 which sets Parameter No. 34, car switch problem position, equal to the position set in steps 183 and 191. Then a pair of steps 194, 195 store the time stamp and floor number, as well as Parameter No. 35, a feature called "car door closed switch open without command". Parameter No. 34, the car door switch problem position, and Parameter No. 15, whether the door opening was in flight, yes or no, are also stored in steps 196 and 197. And then the program reverts to the start state in FIG. 5 through the return transfer point 182.

Figure 7:
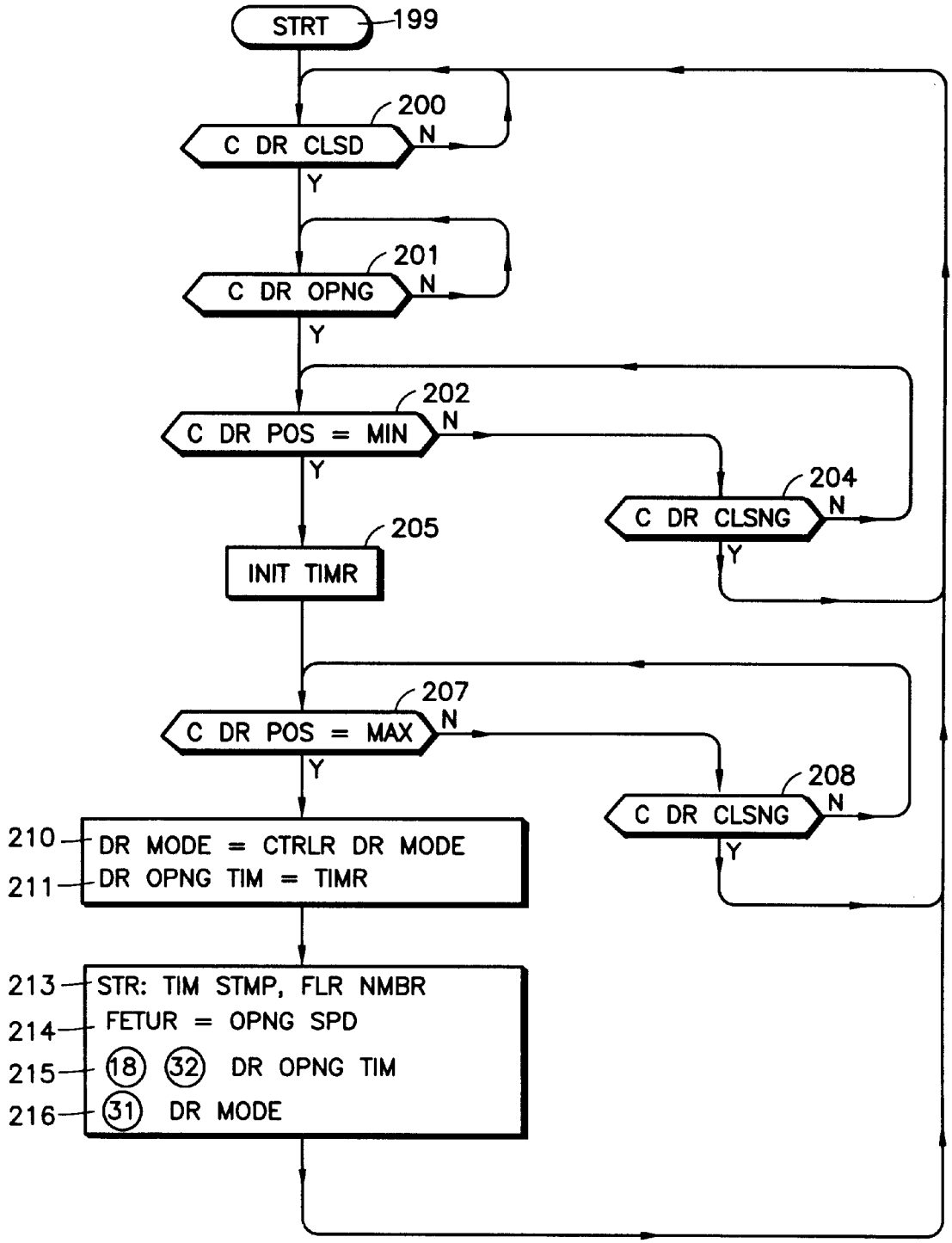

Referring to FIG. 7, a routine relating to door opening time is reached through a start entry point 199 and waits at a test 200 until the car door is closed. Then the routine waits at a test 201 until the car door is opening. Measuring of opening time will begin as soon as the car barely opens to a minimum position, as is determined by a test 202. But if the test 202 is negative, a test 204 determines if the car door is closing, such as when it opens only part way before closing in the nudging mode to prevent further door reversals; in which case the routine will revert to the start state at test 200. In the normal course, the door will quickly reach the minimum position and a step 205 will initiate a timer. As the door opens, the routine cycles between a test 207 to see if the door is essentially fully open at a maximum position, and a test 208 to see if the car door is closing. If the car door begins to close, the test is terminated by the routine reaching the start state at test 200. When the door does reach the maximal position, a step 210 sets a door mode indicator equal to whatever the door controller mode is: the door modes may be opening or closing normally, or opening or closing at a low constant door motor current; a test 211 sets the door opening time equal to the timer setting. Then a series of steps 213–215 store the time stamp and floor number, the feature called "opening speed", as well as door opening time, which can be either Parameter No. 18, average time required to open car door at constant door motor current, or Parameter No. 32 time it takes for the door to open, depending on Parameter No. 31, door mode, which is stored by a step 216. Then the routine reverts to the stop state at the test 200.

Figure 8:
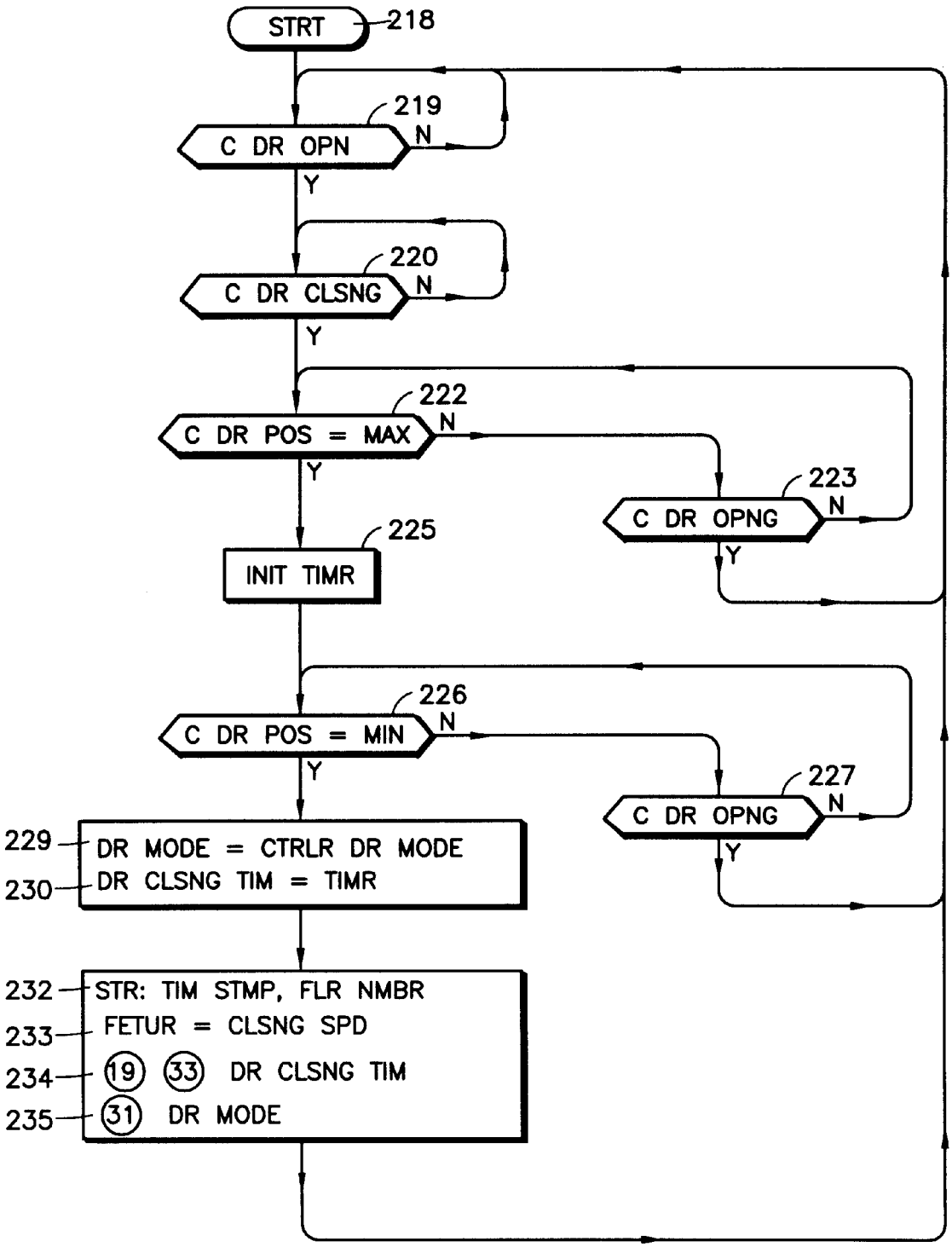

FIG. 8 illustrates a routine for measuring door closing time. Since it is exactly the same as FIG. 7, except relating to closing instead of opening, further description is not required.

Figure 9:
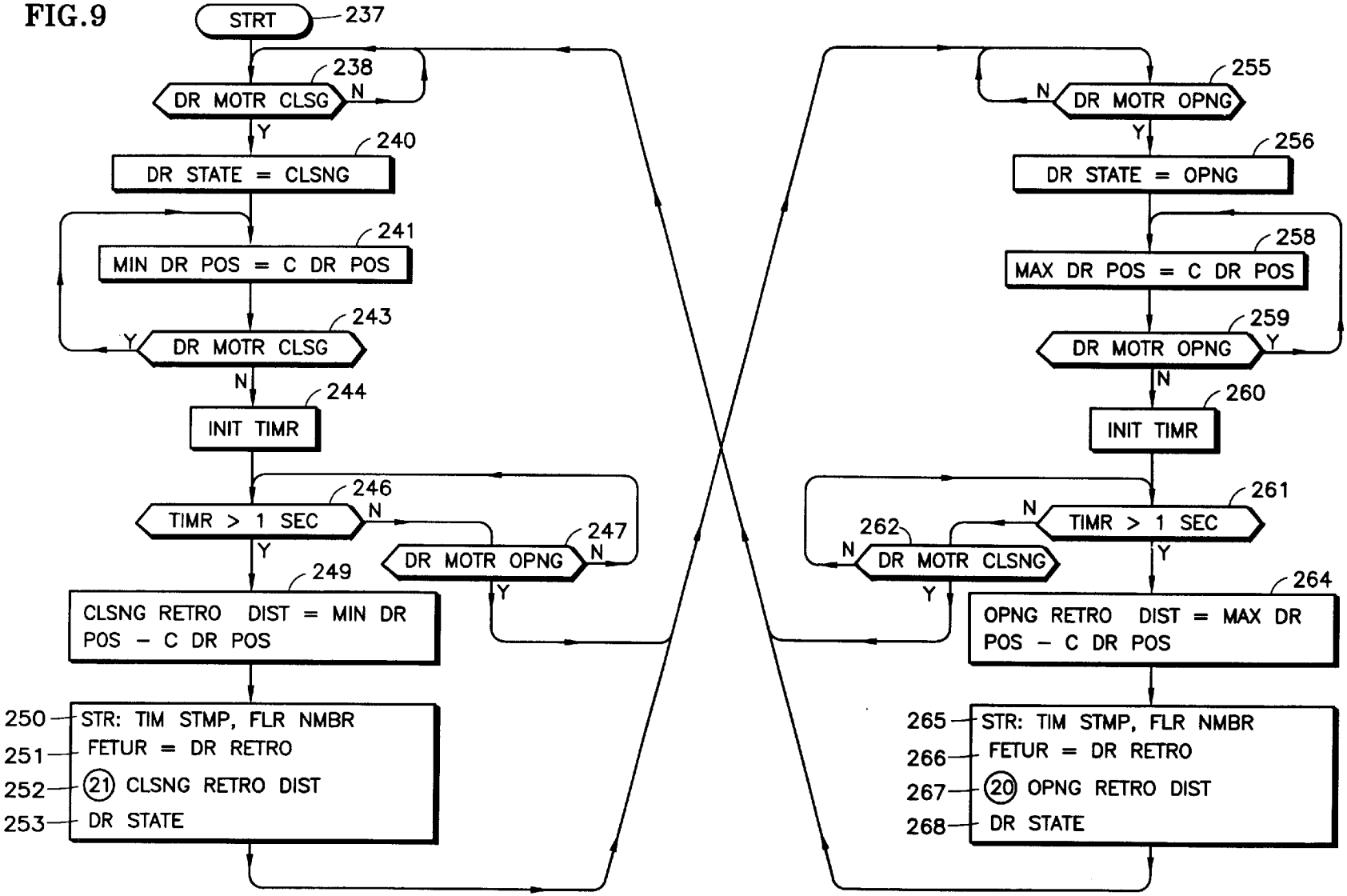

The routine of FIG. 9 determines door distance when the door does not remain fully open or fully closed, due to friction. The routine is reached through a start entry point 237 and then waits at a test 238 until the door motor is closing, which can be determined by the door controller command to the door motor. Once the door motor is closing, a step 240 sets the door state to closing. A step 241 sets the minimum door position equal to the car door position and continuously updates the minimum door position so long as a test 243 indicates that the door motor is still closing. Once the door motor is no longer closing, a step 244 initiates a timer and a test 246 continuously checks to see when the timer has exceeded one second. So long as one second has not passed, a test 247 determines if the door motor is opening or not; if it is, the retrocession test (hereinafter) cannot be made, and an affirmative result of test 247 will cause the routine to advance to the opening tests and steps. In the usual case, if a door open command has not occurred within one second after the door motor ceases to be operating in the closing direction, then the door will remain closed, Then, a step 249 sets the closing retrocession distance equal to the minimum door distance finally established in step 241 minus the present car door position. Then a series of steps 250–253 store the time stamp, the floor number, and a feature called "door retrocession"; Parameter No. 21, the closing retrocession distance, and the door state are also stored. Then the program advances to and waits at a test 255 until the door motor is opening. Then steps and tests 256–268 are performed which are the same as steps and tests 240–253, except that they relate to opening instead of closing. Therefore, further description is not required.

Figure 10:
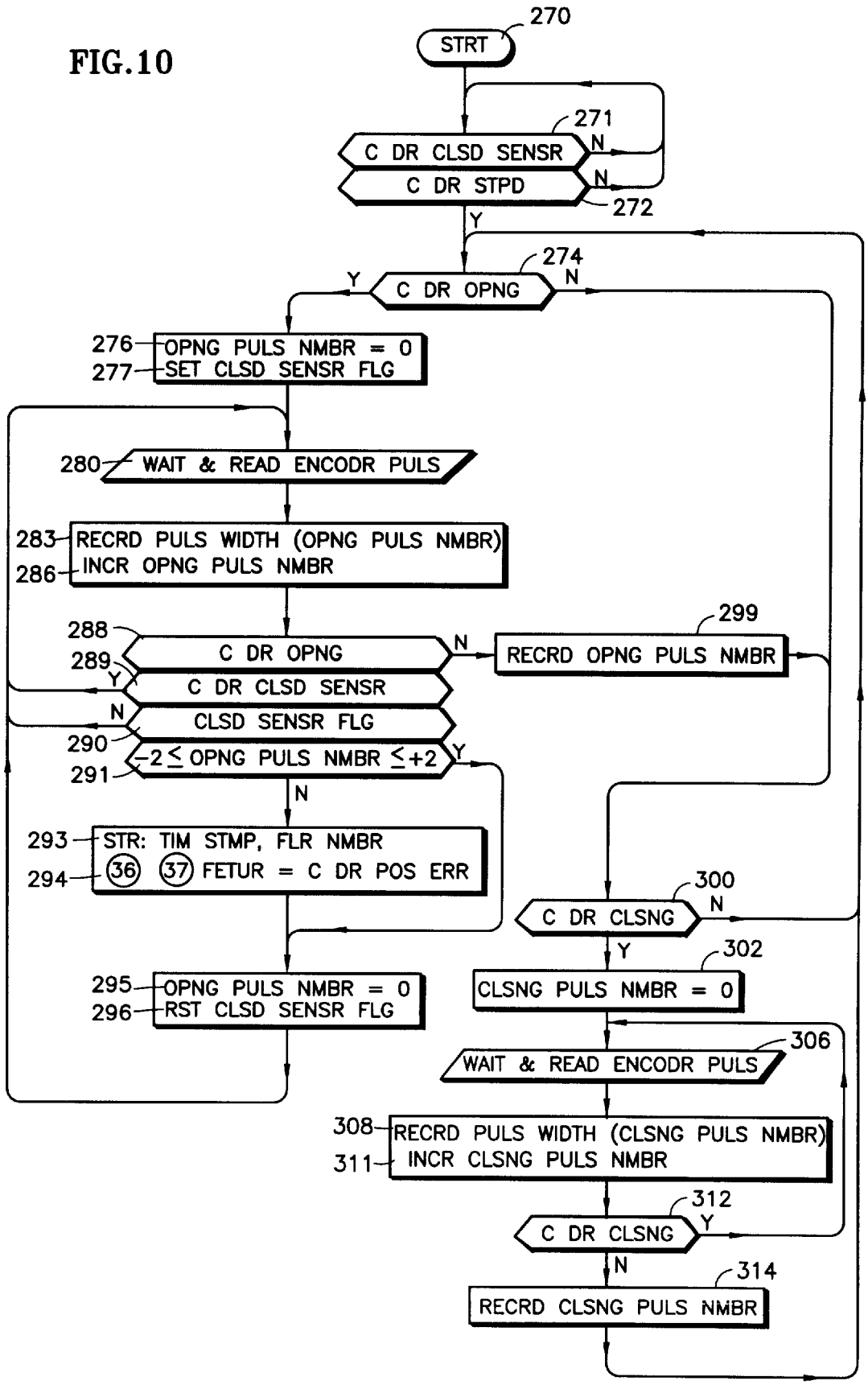

A routine that determines whether or not there is a car door position error is reached in FIG. 10 through a start entry point 270, and the routine then waits at tests 271 and 272 until the car door closed sensor is actuated and the car door is stopped. Then a test 274 determines if the car door is opening. If not, a test 300 determines if the car door is closing. If not, the routine reverts to the test 274. After the car door closed sensor is actuated and the car door is stopped, the next thing to occur will be the car door opening and then a pair of steps 276, 277 set an opening pulse number equal to zero, and set a closed sensor flag which is used in this routine as described hereinafter. Then a subroutine 280 causes the routine to wait and eventually read an encoder pulse when one is emitted from the door position encoder. Each encoder pulse is indicative of so many degrees (or fractions of a revolution), and translates directly to distance of the door position. Thus, knowledge of the pulse count is equivalent to knowledge of the door position. At the same time, the pulse separation (referred to hereinafter as "pulse width") is inversely related to the speed of the door. Each time that the encoder emits a pulse, the routine reaches a pair of steps 283 where the pulse width is recorded as being related to the current opening pulse number, which initially is some negative number, due to the convention established herein that pulse number zero is defined as the pulse where the car door closed sensor is no longer activated (no longer indicates the car door being closed). And then the opening pulse number is incremented in a step 286. A test 288 determines if the car door is still opening; in the usual case it will be so a test 289 determines if the car door closed sensor is actuated, or not. In the first fractions of a second when the car door begins to open, the car door closed sensor will still be actuated so an affirmative result causes the routine to revert to the subroutine 280 to read another pulse, record its width and increment the opening pulse number once again. The program will thus loop through test and steps 280–289 until the car door closed sensor is no longer actuated. Then a test 290 determines if the closed sensor flag, set in step 277, is still set. Initially it will be, so an affirmative result of test 290 reaches a test 291 to see if the opening pulse number is within two pulses of zero, which is the true door closed position and the correct position for the door closed sensor. If it is not within the desired range, then a pair of steps 293, 294 store the time stamp and floor number along with a feature called "car door position error", which is comprised of Parameter No. 36 (car door leaving a closed position sensor as it opens) contemporaneous with Parameter No. 37 (a true car door closed position). On the other hand, if there is no error in the door position, an affirmative result of test 291 will bypass steps 293 and 294. Then a step 295 names the current pulse "zero" to satisfy the convention; the pulse identification of the door closed sensor position is upgraded in every pass through the routine at step 295. A step 296 resets the closed sensor flag so that in subsequent passes through the steps and tests 280–290 the door closed position sensor test 291 will not be performed, as the door continues to open. When the car door is fully open, the test 288 will be negative reaching a step 299 which records the opening pulse number, indicative of the number of pulses which have occurred and therefore the actual open position of the car door once it ceases opening. This number is used in FIGS. 11–14 as described hereinafter. The routine will then loop through tests 300 and 274 until the door begins closing. Then a step 302 sets the closing pulse number equal to zero and the subroutine 306 waits to read the next encoder pulse, when it occurs. After the next encoder pulse is read, a pair of steps 308, 311 record the pulse width in association with the closing pulse number and then the closing pulse number is incremented in a step 311. A test 312 determines if the car door is still closing. So long as it is, the routine will read successive pulse numbers and record the pulse width. However, once the car door stops closing, a negative result of test 312 reaches a step 314 to record the closing pulse number for use in FIGS. 11–14.

Figures 11, 12:
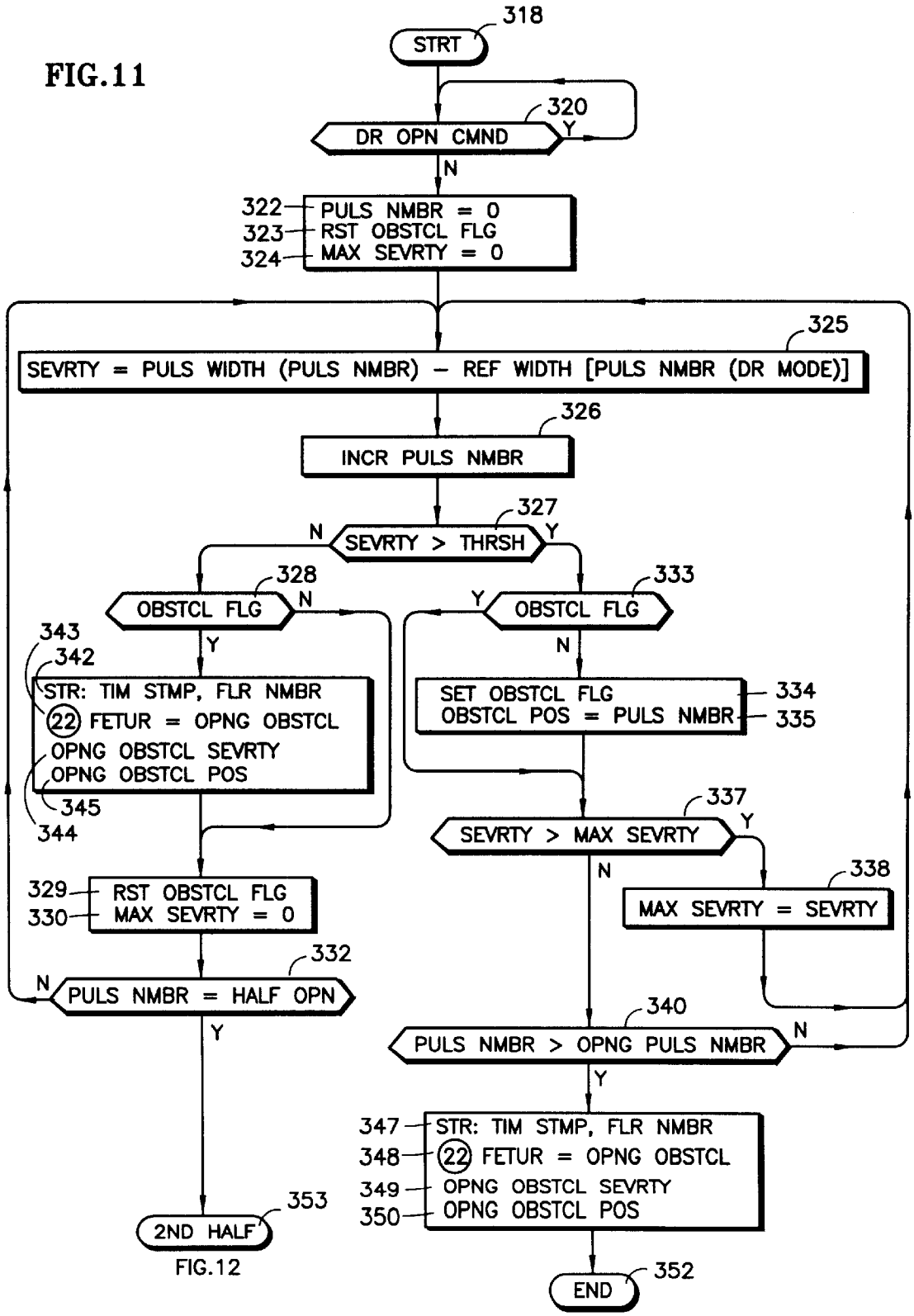
Figure 12:
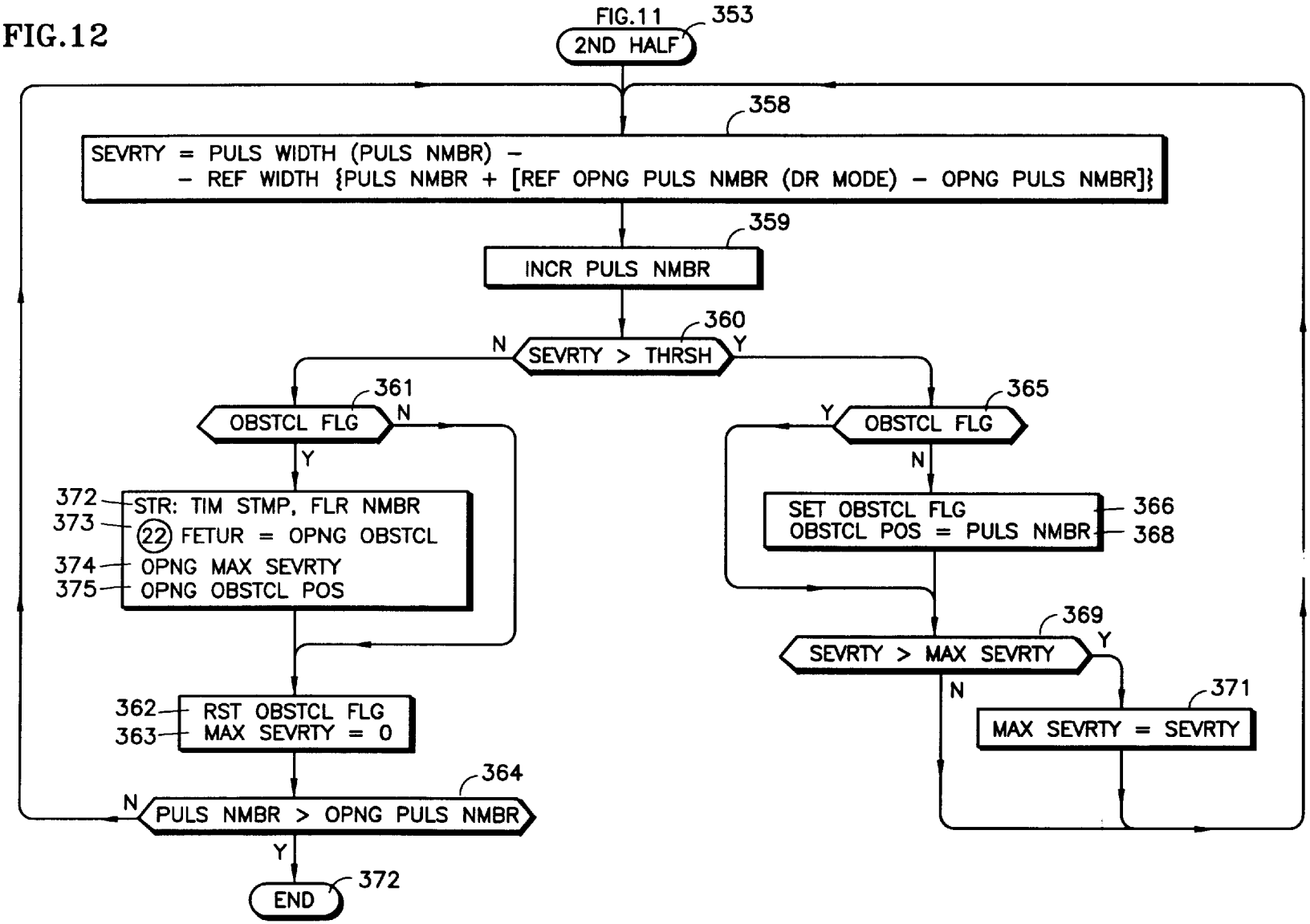

A routine that checks for obstacles or other impediments that slow the door down is reached in FIG. 11 through a start entry point 318, and the routine waits at a test 320 until the end of a door open command, indicating that the process of recording pulse widths as the door opens has finished, so that this routine can begin. Then, a series of steps 322–324 initialize a pulse number used in the routine equal to zero, reset an obstacle flag used in the routine, and initialize the maximum severity (the severity of slowing the car door down) to zero. Pulse widths stored according to pulse number as described in FIG. 10 are then compared against previously determined reference pulse widths in a step 326. The severity of slowing down is equal to the pulse width of a particular pulse number minus the reference width for that same particular pulse number of a reference door motion profile for the particular door mode of the door when the pulse widths were recorded as described in FIG. 10. Then the pulse number is incremented in a step 326 and a test 327 determines if severity exceeds a threshold. If the car door is slowed just a small amount which is inconsequential, the extra width between pulses will be less than the threshold, so a test 328 determines if the obstacle flag (reset in step 323) has been set or not. Until severity exceeds the threshold, the obstacle flag will not be set, so a pair of steps 329, 330 reset the obstacle flag (in this case, redundantly) and reestablish maximum severity at zero, for purposes described hereinafter. Then a test 332 determines if the pulse number is high enough to indicate that the door is half open. Initially it will not be, so severity of another pulse is determined in step 325 once again. Assume now that there is a significant obstacle so that severity is greater than the threshold in test 327. A test 333 determines that the obstacle flag has not yet been set, so that a step 334 will set the obstacle flag and a step 335 will set the obstacle position equal to the pulse number. Then a test 337 determines if the severity sensed in step 325 exceeds the previously established maximum severity; initially, any severity greater than the threshold will be higher than the zero maximum severity set in step 324, so an affirmative result of test 337 will reach test 338 to set the maximum severity equal to the severity most recently set in step 325. Then the program reverts to step 325, and again the test 327 determines if severity is more than the threshold. Assuming there is an obstacle, there will be several pulses exceeding the threshold so affirmative results of step 327 will reach test 333 which now is affirmative since the obstacle flag has been set. Test 337 will continue to be affirmative and step 338 will continue to update the value of maximum severity until the peak of the slowdown is reached. Thereafter, severity will no longer be greater than maximum severity so a negative result of test 337 reaches a test 340 which determines if the current pulse number exceeds the opening pulse number (the pulse number at the point where the door stopped as described in FIG. 10). In the general case, within the first half of the pulses, the pulse number will not exceed the opening pulse number so a negative result of test 340 reverts the program to the step 325. Thereafter, the routine will proceed through test 327, test 353, test 337 and test 340 until the severity no longer exceeds the threshold, indicating that the end of the obstacle or other impediment has been reached. Then a negative result of test 327 reaches test 328 which is now affirmative, so a series of steps 342–345 store the time stamp and floor number, a feature called "opening obstacle" which is Parameter No. 22, the value of the maximum severity determined in step 338, and the obstacle position provided by step 335. It should be understood that position will be determined by converting the pulse number into distance, a relationship which is fixed in any given door. After the peak of one obstacle or other impediment has been reached, and the event has been stored in steps 342–345, the obstacle flag and maximum severity are reset in steps 329 and 330 so the system will be ready to deal with an additional obstacle, should there be one.) If the door had become stuck in the first half of its motion as it opened during the procedures described with respect to FIG. 10, the test 340 would be affirmative reaching a series of steps 347–350 which store the time stamp and the floor number, Parameter No. 22, the feature called "opening obstacle", the maximum severity and obstacle position, all as described hereinbefore.

In the normal course, the routine will continuously pass through the step 325 looking for slow downs at test 327. If the door does not get stuck during the first half of its opening movement, eventually test 332 will be affirmative causing the routine to continue in FIG. 12 through a "second half" transfer point 353.

Figure 13:
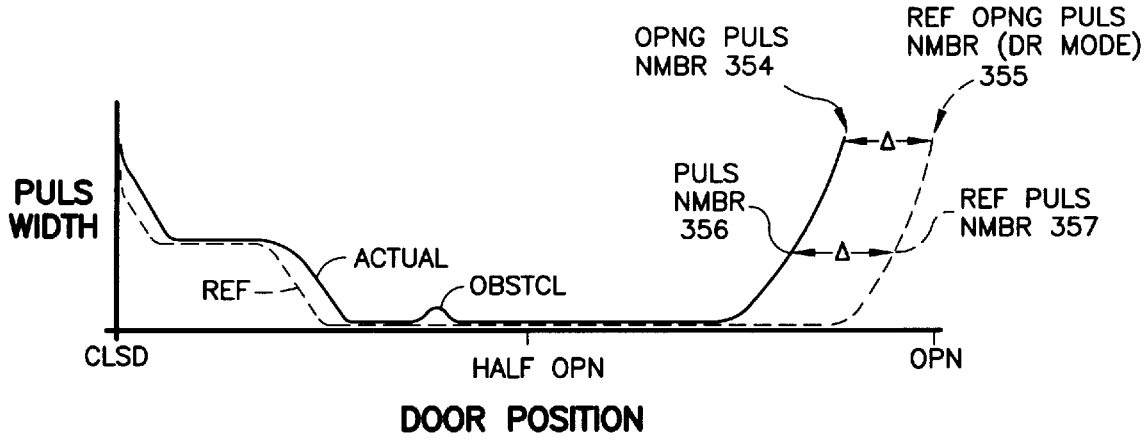
FIG. 13 is a plot of pulse width versus door position.

Referring to FIG. 13, if the door does not open as fully as the door opened when the reference pulse widths were recorded along with the reference pulse numbers, during a previous special test, then the actual speed profile will have increasing pulse widths (denoting deceleration to a stop) at lower pulse numbers than is the case in the reference speed profile. The actual opening pulse number is indicated in FIG. 13 at 354, for the actual door motion profile, and the reference opening pulse number, for a particular door mode, is illustrated at 355. In FIG. 11, the second half of the routine begins with the difference, Δ, of FIG. 13 being determined within the square brackets of a step 358 as the reference opening pulse number for the given door mode, minus the actual opening pulse number, to which the pulse number is added before determining the reference pulse number from which the reference width should be taken.

The remainder of FIG. 12 operates in a fashion which is identical to that described with respect to FIG. 11 hereinbefore, and further description is not needed.

Figure 14:
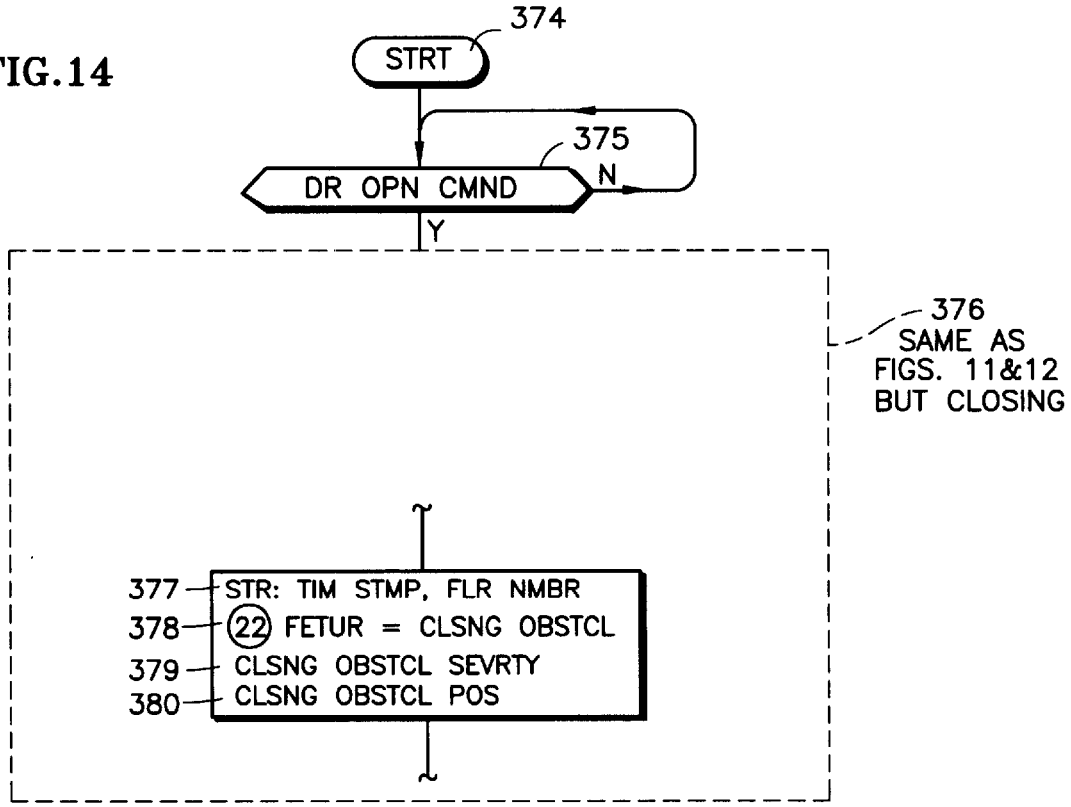
FIGS. 14–25 are logic flow diagrams of routines related to features and parameters as follows.

In FIG. 14, obstacles to the door closing are detected in a manner that is identical to opening obstacles described with respect to FIGS. 11–13, so further description is unnecessary.

Figure 15:
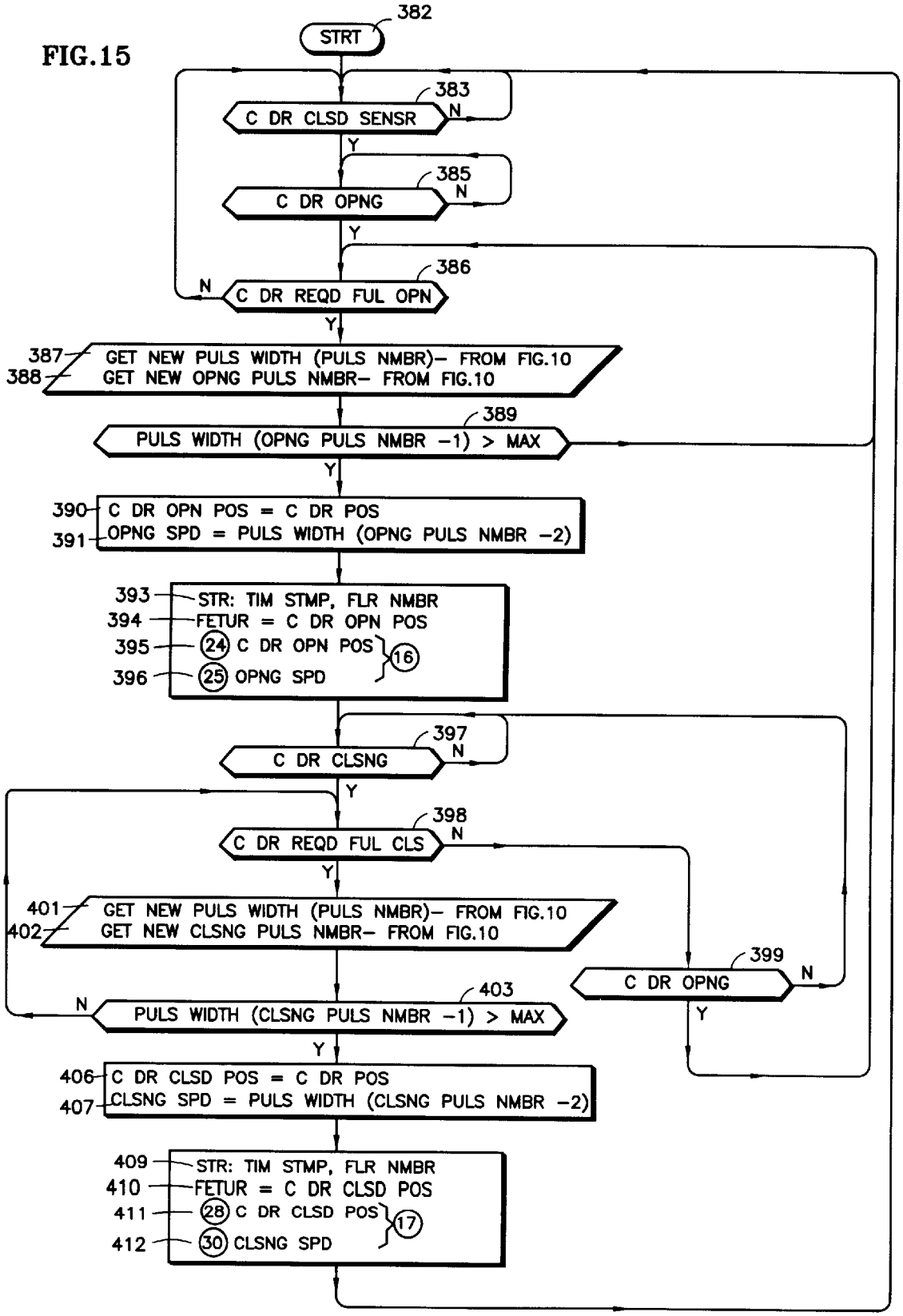

In FIG. 15, a routine which provides car door open and closed position, and opening and closing speeds, is reached through a start entry point 382, and the routine waits at a step 383 until the car door closed sensor is actuated, indicating that the car door is fully closed. Then the routine waits at step 385 until the car door is opening. A test 386 determines if the car door is required to fully open; normally it is, but it may not be, such as during nudging (after many door reversals). Then a subroutine is reached having a portion 387 which will get a new pulse width as soon as one is available from the subroutine 280 in FIG. 10 and a portion 388 which gets the current opening pulse number as soon as it is established in step 286 of FIG. 10. This is possible because both routines run at the same time, since the test 274 in FIG. 10 as the same as the test 385 in FIG. 15: car door opening. Then a test 389 determines if the pulse width of the pulse number which is one less than the current opening pulse number has a width that exceeds a maximum; if it does, this means that the car is almost stopped. If not, the routine loop backs to test 386 to get another pulse width and another opening pulse number and to test the pulse width to see if it is wide enough to indicate that the car is essentially stopped. Eventually, an affirmative result of test 389 will reach a step 390 to set the car door open position equal to the current car door position, and a step 391 to set opening speed equal to the pulse width of a pulse number which is two less than the ultimate opening pulse number. The pulse width of that pulse can be converted accurately to the car door speed, and the pulse number two less than the ultimate opening pulse number is chosen since that is a final opening speed just before the car door is stopped. Next, a series of steps 393–396 store the time stamp and floor number and a feature called "car door open position"; Parameter No. 24, car door open position and Parameter No. 25 opening speed are also stored.

In FIG. 15, the routine then waits until a test 397 indicates that the car door is closing; then a test 398 determines if the car door is required to close fully. If not, a test 399 determines if the car door is opening, which frequently happens because of passenger activation of a between door safety device, a door close button, or a hall call button. If the car door is opening, then the program reverts to the test 386, as described hereinbefore. If the car door is not opening, the routine reverts to test 397 and 398 waiting for a full door closing operation. When that occurs, a subroutine is reached having a portion 401 to get a new pulse width and associated pulse number from FIG. 10, and a portion 402 to get a new closing pulse number, also from FIG. 10. Then a test 403 determines if the most recent pulse width of the pulse number which is one less than the closing pulse number is greater than a maximum value, indicative of the car door being essentially stopped, and therefore fully closed. If not, the routine loops through the test and steps 398–403 until the door is closed. Then, the step 406 sets the car door closed position equal to the current car door position, and a step 407 sets the closing speed equal to the pulse width of a pulse number which is two less than the closing pulse number; this pulse width can be converted to the final closing speed of the door. A set of steps 409–412 store the time stamp and floor number and a feature called "door closed position"; Parameter No. 28, car door closed position, and Parameter No. 30, closing speed are also stored. Then the program reverts to the start state at test 383.

Figure 16:
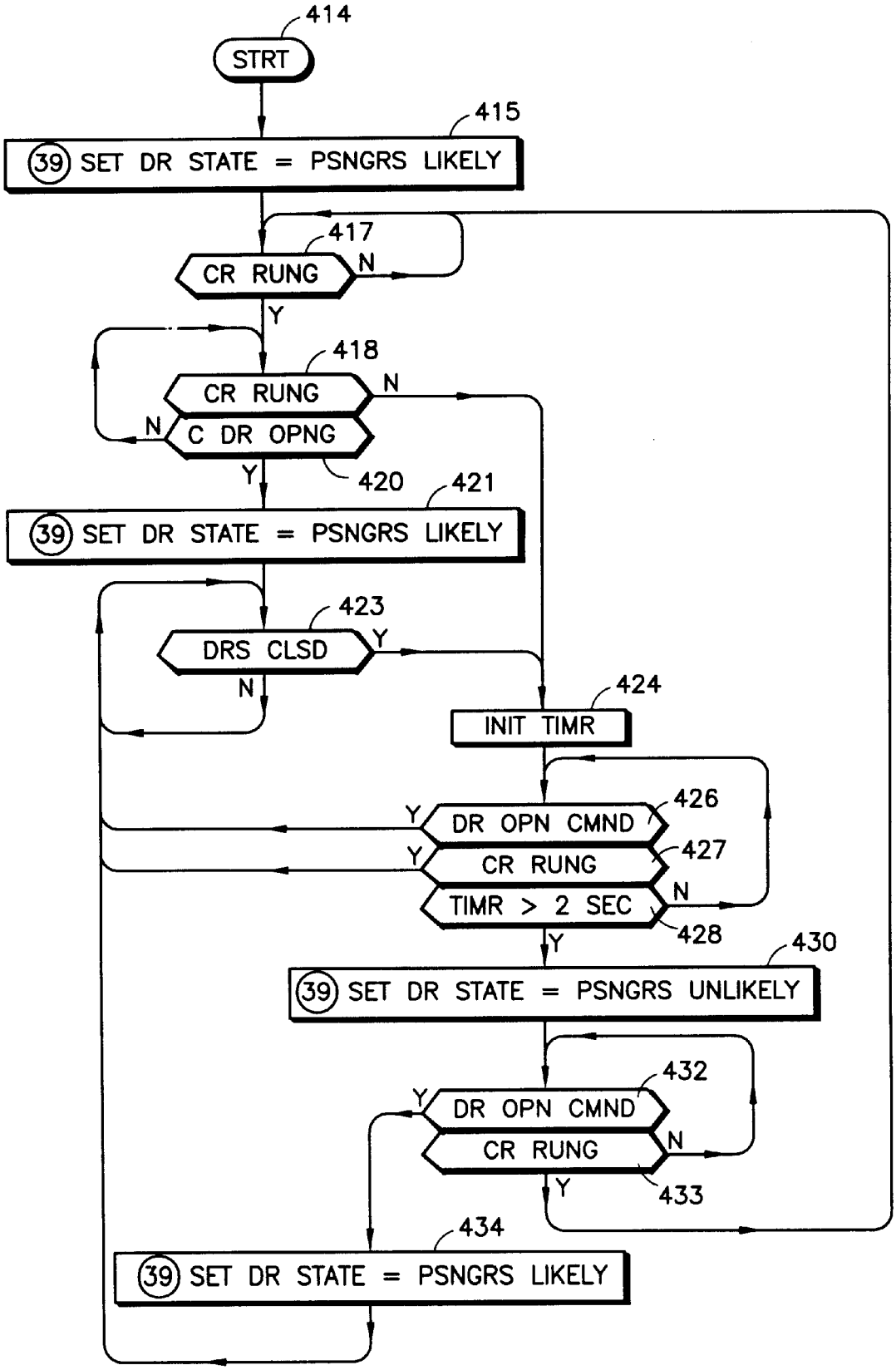

In FIG. 16, a routine determines if the car door has been closed with the car at a landing for a period of time, such as two seconds, or which indicates that it is unlikely that passengers are interacting with the door. Otherwise, it is determined that it is likely that passengers are interacting with the door. In FIG. 16, the routine is entered through a start entry point 414 and a step 415 sets the door state, which is Parameter No. 39, to indicate passengers are likely (to interact with the door). The routine then waits at test 417 until the car is running. Then the routine advances through tests 418 and 420 to determine if the car door is opening while the car is still running, or not. If the car stops running before the car door opens, this means that the car is being parked and passengers interacting with the door is unlikely. But if the car door starts opening while the car is still running, this means it has reached a door zone at a landing, and interaction of passengers with the door is likely. Therefore, a step 421 sets the door state to indicate passengers are likely (perhaps redundantly) and the routine then waits at a test 423 until the doors are closed. Once the doors are closed, it is not likely that the passengers will interact with the doors, so a step 424 initiates a timer. However, if there is a door open command, then a test 426 will cause the routine to revert to the test 423. If the car is running, a test 427 causes the program to revert to test 423. But if both tests 426, 427 are negative, then a test 428 determines if the timer has reached two seconds or not. If not, the routine waits at tests 426–428 until the timer times out. Then a step 430 sets the door state to indicate that interaction of passengers with the door is unlikely. A pair of steps 432, 433 determines if the car door open command appears before the car starts to run. If it does, then a step 434 sets the door state to indicate that the interaction of passengers with the door is likely, and the program reverts to the test 423. However, if the car is running before there is a door open command, then the routine reverts to the test 417. Thus, the door state indicates that interaction of passengers with the car door is unlikely when the car door is parked (not running) with the doors closed for a predetermined time (such as two seconds).

Figure 17:
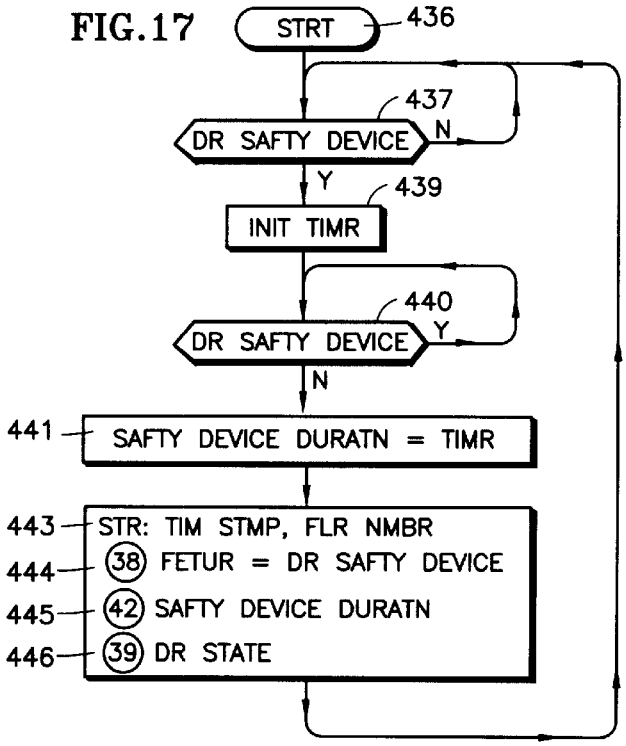

In FIG. 17, a routine which determines operation and duration of operation of a between-door safety device is reached through a start entry point 436 and the routine then waits at a test 437 until the door safety device is actuated. Then a timer is initiated in a step 439 and the routine waits at a test 440 until the door safety device is no longer actuated. When that happens, a step 441 sets the safety device duration equal to the setting of the timer. Then a series of steps 443–446 store: the time stamp and floor number; Parameter No. 38, which is the feature known as "door safety device"; Parameter No. 42, the safety device duration, and Parameter No. 39, the door state which is established in FIG. 16. Then the program reverts to the start state at the test 437.

When dealing with hall call buttons and lights and car call buttons and lights, it should be borne in mind that the landing related thereto is different from the floor number (which is generally recorded in most of the routines hereinbefore) because the landing number relates to the floor for which a call is being entered, whereas the floor number relates to the position of the elevator car.)

Figure 18:
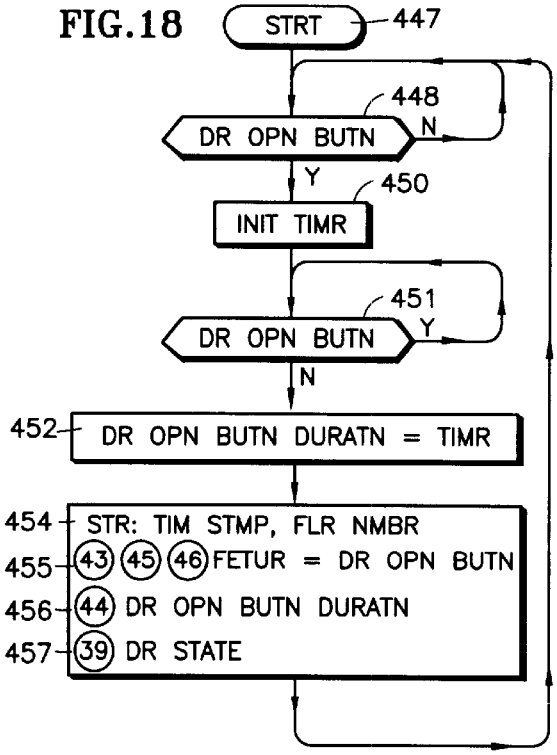
Figure 19:
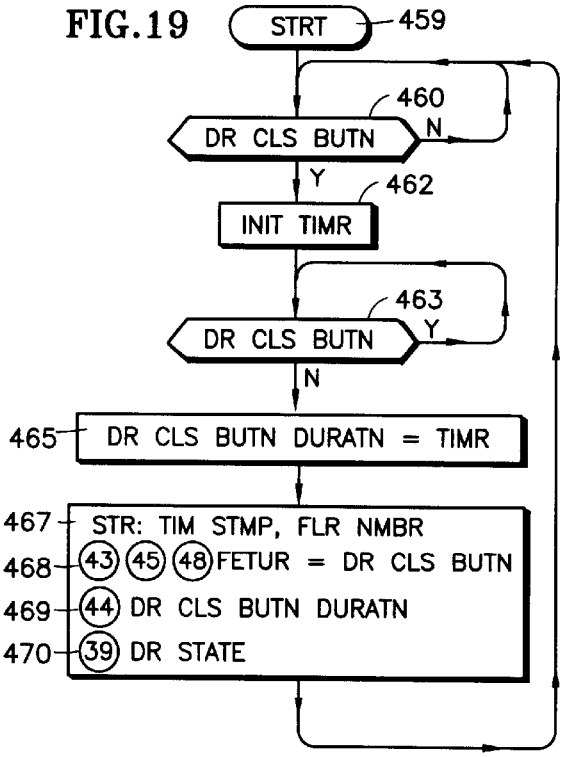

Routines that similarly sense operation of a door open button or a door close button, and the duration that the buttons are operated, are set forth in FIGS. 18 and 19; because these routines operate exactly as described with respect to FIG. 17, except relating to the door buttons, further description is not required.

Figure 20:
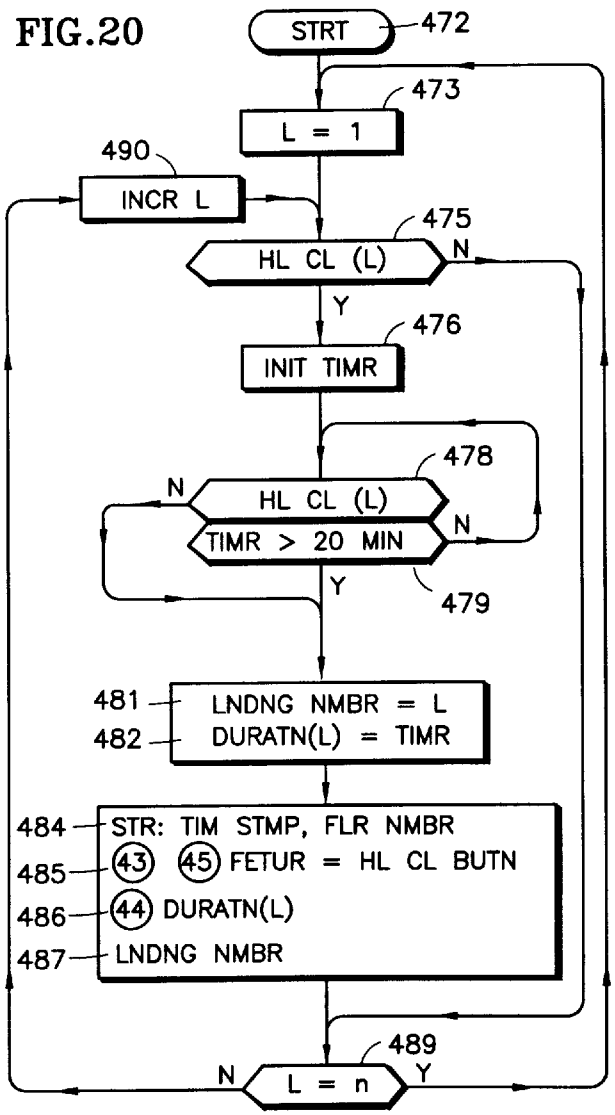

A routine for recognizing stuck hall call buttons (also called landing call buttons herein) is reached in FIG. 20 through a start entry point 472 and a first step 473 sets a landing counter value, L, equal to one. A test 475 determines if a hall call button for landing L is pressed; if it is, a step 476 initiates a timer and then the routine waits at tests 478 and 479 until either the hall call button is released or 20 minutes have expired. Then a step 481 sets the landing number equal to L and a step 482 sets the duration for landing L to the setting of the timer. A pair of steps 484, 485 store the time stamp and floor number as well as Parameter No. 43, a feature called "hall call button". Then Parameter No. 44, the duration for landing L, and the landing number are stored by steps 486, 487. Then a test 489 determines if all of the landings in the building have had their hall call buttons tested or not; initially, they will not so a negative result of test 489 reaches a step 490 to increment L, and the routine repeats for the next landing in turn. If on the other hand, the hall call button for landing L had not been pressed in the first instance, a negative result of test 475 will have bypassed steps and tests 476–487. When all landings have been tested, an affirmative result of test 489 causes the routine to revert to the start state at step 473.

Figure 21:
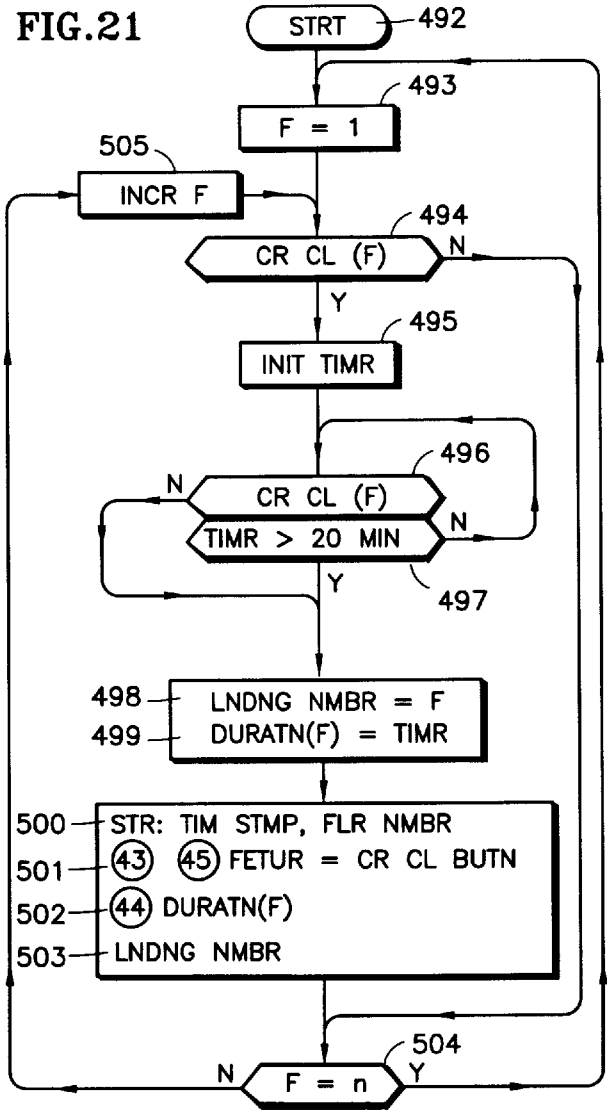

The routine of FIG. 21 which determines operation and duration of car call buttons operates identically to FIG. 20, and further description is not required. However, it should be understood that both Parameter No. 43 and Parameter No. 44 relate to either a hall call (landing call) button or a car call button.

Figure 22:
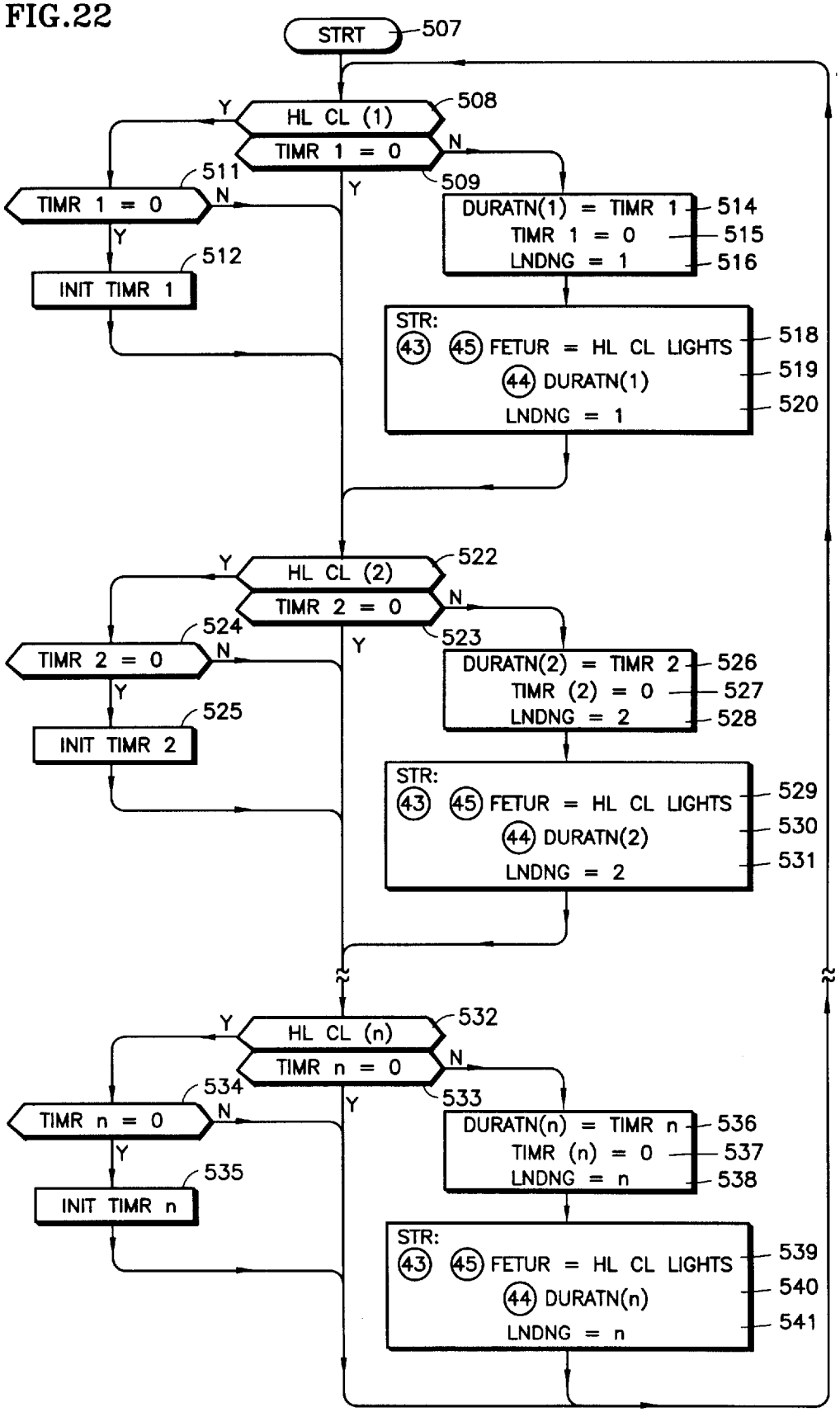
Figure 23:
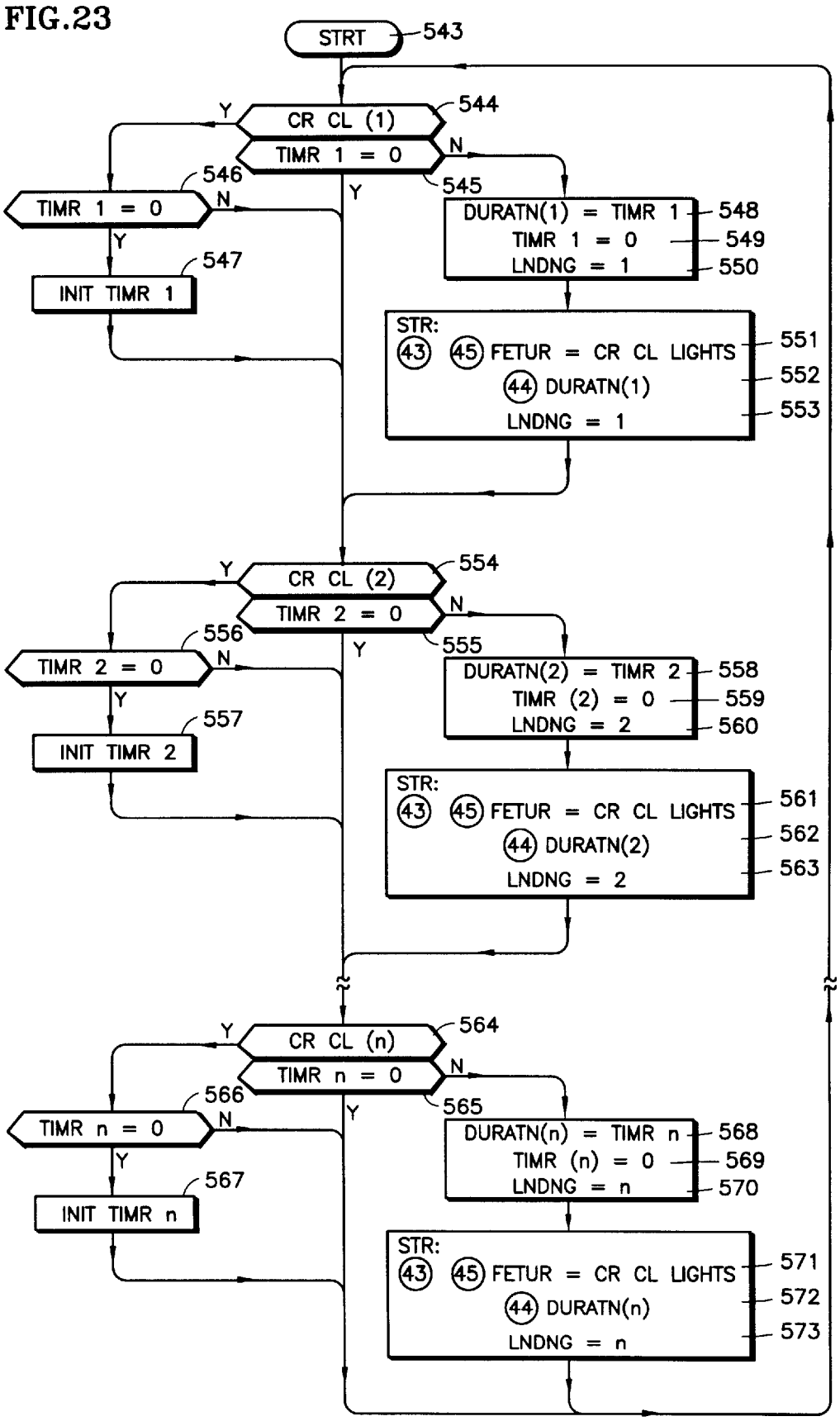

In FIG. 22, a routine for determining the occurrence and duration of hall call (landing call) button lights being lit is reached through a start entry point 507 and a first test determines if a hall call is registered for the first landing 508. If not, a test 509 determines if a timer has already been set, or if it still equals zero. If it still equals zero, then the routine advances toga test 522 related to the hall call for the second landing. However, if a hall call is registered for the first landing, then a test 511 determines whether the timer has been initiated or not. If it has not, it will still be set to zero so an affirmative result of test 511 reaches a step 512 to initiate timer 1, which will time the hall call signal on the first landing. Then the program advances to the next test 522 relating to the second landing. Then the program will deal with hall calls on all of the landings, after which it reverts to the test 508. If the hall call is still registered, then test 511 will be reached, but this time it will be negative since the timer was initiated and no longer is resting on zero. The routine will once again pass through tests for hall calls on each of the landings and again revert to the test 508. Assuming now that the hall call has terminated, a negative result of test 508 reaches step 509 which this time is negative, thereby reaching steps 514–516 to set the duration for landing one equal to timer 1, to reset timer one to zero so it will be ready for a subsequent operation of the hall call button, and to set the landing (related to this feature) equal to 1. Then, a step 518 will store Parameter Nos. 43 and 45 (because these parameters relate both to hall call lights and car call lights), which is a feature called hall call lights. A step 519 stores Parameter No. 44, the duration of the hall call at the first landing, and a step 520 stores the landing number established in step 516. And then the routine reaches the step 522 to make similar tests and perform similar steps. Since the remainder of FIG. 22 operates as described with respect to steps and tests 508–520, further description is not required. Similarly, FIG. 23, relating to car calls, operates in a fashion identical to FIG. 22 and further description is not required.

Figure 24:
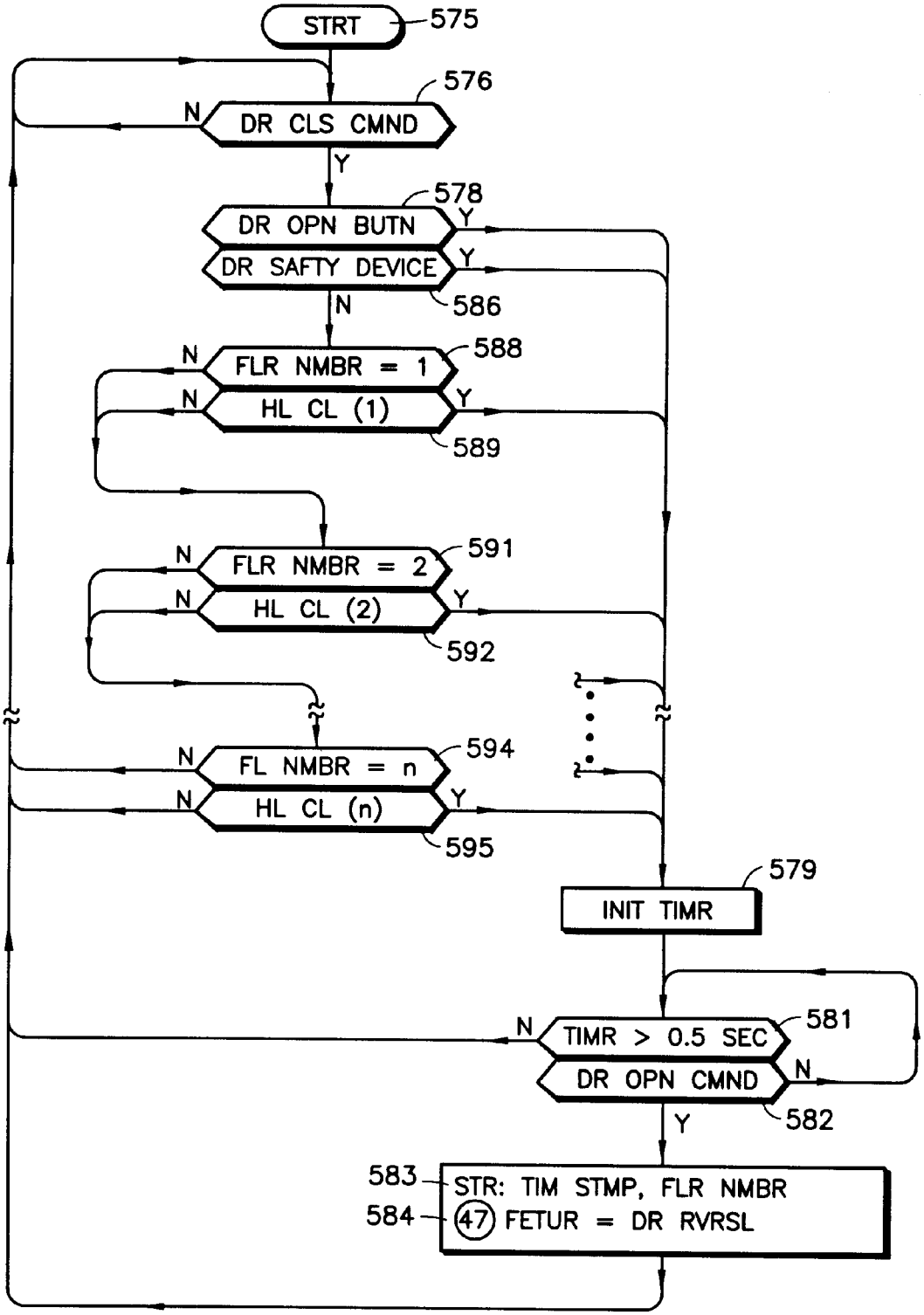

A routine which detects door reversals is reached in FIG. 24 through a start entry point 575, and the routine waits at a test 576 until there is a door close command, because door reversals only occur when the door is closing. Then a test 578 determines if the door open button has been pressed. If so, a step 579 initiates a timer and then the routine loops through tests 581 and 582 until either the timer exceeds one-half second, or there is a door open command. If there is no door open command within one-half second, this means that, despite pressing the door open button, a door reversal will not occur. This circumstance can happen when the door is in a nudging mode, in which the door is being forcibly closed at a very low speed. In the usual case, pressing the door open button, activation of a between-door safety device, or pressing a landing call (hall call) button, will result in a door open command to effect a door reversal. This will come well within one-half second so that an affirmative result of test 582 will reach a pair of steps 583 which store the time stamp and floor number and Parameter No. 47, a feature called "door reversal". If the door open button has not been pressed, a test 586 determines if the between-door safety device has been activated; if so, the routine is as described hereinbefore; if not, hall call buttons and elevator floor positions are tested in tests 588–595 to see if the door should be reversed due to a hall call; if so, the routine is as described hereinbefore.

Figure 25:
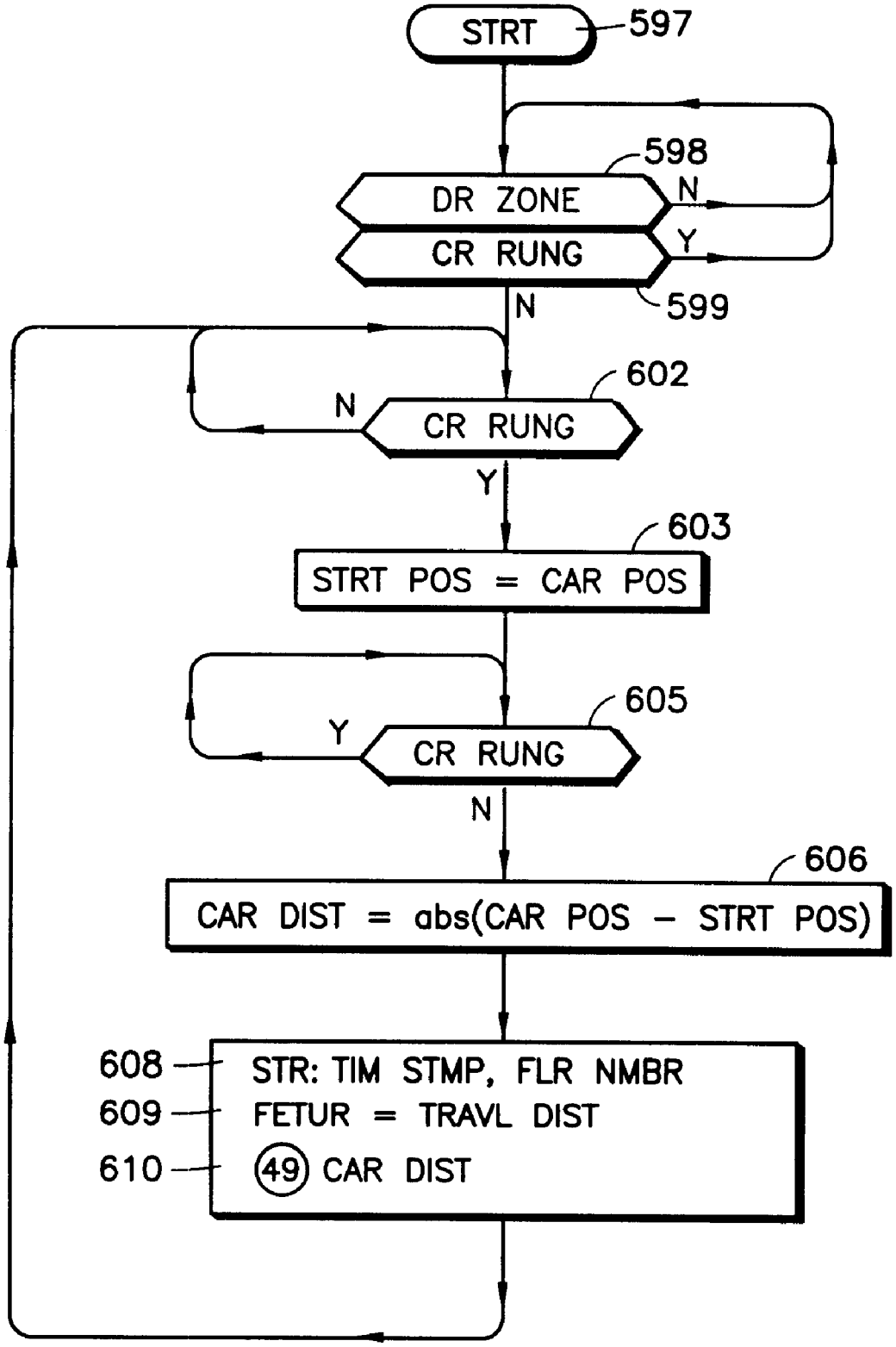
Figure 26:
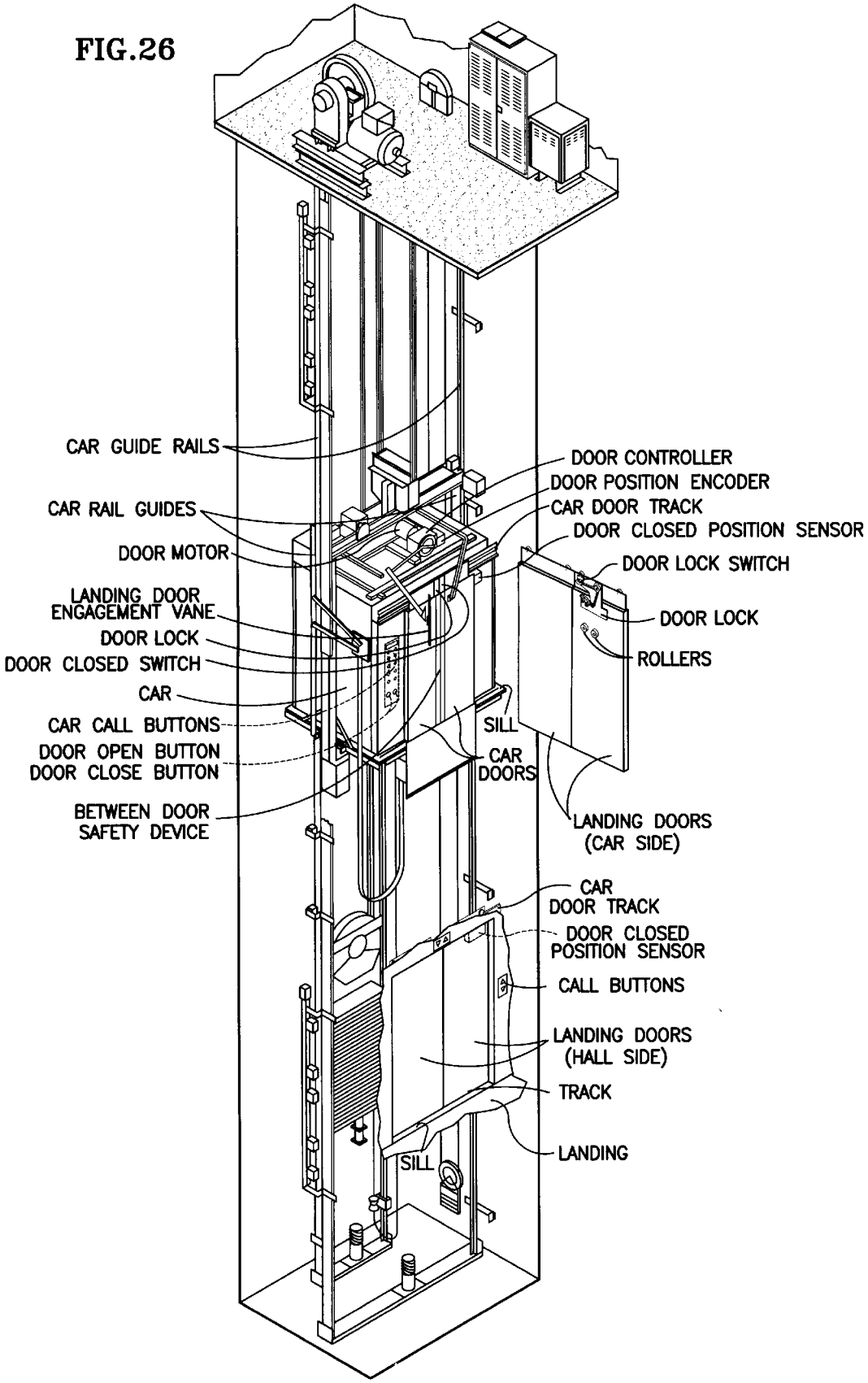
FIG. 26 is a perspective view, partially broken away, of a conventional elevator system with which the present invention may be practiced.

The routine in FIG. 25 accumulates the total distance which the elevator car has traveled. The routine is reached through a start entry point 597 and then waits at tests 598 and 599 until the car is within a door zone with the car not running, that is, with the car stopped. Then it waits at a test 602 until the car runs again, and a step 603 sets a start position equal to the present car position; then the routine waits at a test 605 until the car is stopped once again. Then a step 606 sets the car distance equal to the absolute value of the present car position minus the start position. A series of steps 608–610 store the time stamp and floor number, a feature called "travel distance" and Parameter No. 49, car distance. Then the routine reverts to the step 602 to wait until the car runs once again.

According to the invention, maintenance recommendation messages may contain two portions: a first portion is a general recommendation such as directing that the position of a door vane be adjusted (paragraphs (A)–(D) hereinafter); a second portion includes an indication of the reason for the recommended action, such as that a door vane is mispositioned (which is determined from the landing door locking at an excessively wrong position, too often, at an excessive number of landings) as in paragraph (C) hereinafter, and an indication of the severity, which may be in the nature of a specific recommendation, such as directing that a door vane be moved according to the excess of the position, as in paragraph (A) hereinafter, or it may be an indication of the frequency of some occurrence (as in paragraph (D) hereinafter), the number of occurrences (as in paragraph (L) hereinafter), or a magnitude (as in paragraph (R) hereinafter. In the usual case, all three indications will be utilized. In some cases, examples of which are given herein, a particular message may not contain a severity indication. In any case, if desired, the invention may be practiced with less than all of the three indications, and may be practiced without the first general maintenance portion in the event that the second or third indication is sufficient as described herein to enable maintenance personnel to determine the action to be taken, or if the second or third indications are modified somewhat so as to inform maintenance personnel what the recommended action is.

A conventional door vane works with rollers so that when the car door opens or closes it pulls the landing door along with it. Maintenance messages which may direct that a door vane be adjusted provide information concerning what is wrong and some related parameter, all of which will assist service personnel in understanding the situation.

The messages of paragraphs (A)–(D) may include a first portion which directs that the position of the related door vane be adjusted, if desired; otherwise, the messages of paragraphs (A)–(D) need not include the first portion:

(A) determining, from a landing door lock opening (Parameter No. 1, FIG. 1), when the car door is either too far open or not open enough, too often, at an excessive number of landings, that a door vane is mispositioned, and generating a reason and severity portion of a maintenance message indicative thereof, including directing that the related door vane be moved accordingly;

(B) determining that a landing door lock switch fails to close (Parameter No. 2, FIG. 2) when the landing door closes (Parameter No. 3, FIG. 2), too often, at an excessive number of landings, and generating a reason and severity portion of a maintenance message indicative thereof including the frequency of such failures;

(C) determining that a landing door lock switch opens (Parameter No. 2, FIG. 2) without a door open command (Parameter No. 4, FIG. 2), too often, at an excessive number of landings, and generating a reason and severity portion of a maintenance message indicative thereof including the frequency of such openings;

(D) determining that a landing door lock switch is not open when the related landing door is open (Parameter No. 5, FIG. 1), too often, at an excessive number of landings, and generating a reason and severity portion of a maintenance message indicative thereof.

The messages of paragraphs (E)–(G) may include a first portion that directs that the alignment of the related landing door lock be adjusted, if desired; or, the messages of paragraphs (E)–(G) need not include the first portion:

(E) determining, from a landing door lock opening (Parameter No. 1, FIG. 1) when the car door is either too far open or not open enough, and there is no maintenance message of paragraphs (A)–(D) to adjust a door vane, too often, at a small number of landings, that the door lock alignment is wrong, and generating a reason and severity portion of a respectively corresponding maintenance message indicative thereof directing that the door lock at such landing be moved a corresponding amount in an appropriate direction;

(F) determining that the landing door lock switch at a landing fails to close (Parameter No. 2, FIG. 2) when the landing door closes (Parameter No. 3, FIG. 2), too often, and generating a reason and severity portion of a maintenance message indicative thereof including the frequency of such failure;

(G) determining that the landing door lock switch opens at a landing without a door open command (Parameter No. 4, FIG. 2), too often, when there is no maintenance message of paragraphs (A)–(D) to adjust a door vane, and generating a reason and severity portion of a maintenance message indicative thereof including the frequency of such openings.

The maintenance messages of paragraphs (H)–(L) may include a first portion directing that the related landing door lock be cleaned or adjusted, if desired; otherwise the messages of paragraphs (H)–(L) need not include the first portion:

(H) determining, from a landing door lock switch rebounding from closed to open (Parameter No. 6, FIG. 3) when the door closes with a high final closing speed (Parameter No. 7, FIG. 3), insufficiently often, when there is no maintenance message of paragraphs (A)–(D) to adjust a door vane, that the door lock has excessive friction, and generating a reason and severity portion of a maintenance message indicative thereof including an indication of the deficient number of rebounds;

(I) determining that a landing door has operated (Parameter No. 8) more times than a related periodic inspection threshold number of times, and generating a reason and severity portion of a maintenance message indicative thereof including the excess of such times over the threshold;

(J) determining, from a landing door lock switch, rebounding from closed to open (Parameter No. 6, FIG. 3) when the door closes with a low final closing speed (Parameter No. 7, FIG. 3) and there is no maintenance message of paragraphs (A)–(D) to adjust a door vane, too often, that cleaning of the switch is required, and generating a reason and severity portion of a maintenance message indicative thereof including the frequency of such rebounds;

(K) determining that the total number of landing door lock switch operations (Parameter No. 11, from a conventional door operation counter, not shown) exceeds a related threshold, and generating a reason and severity portion of a maintenance message indicative thereof including an indication of the number of such operations;

(L) determining that a landing door lock switch is not open when the related landing door is open (Parameter No. 5, FIG. 1), for a small number of landings, and generating a reason and severity portion of a maintenance message indicative thereof including the frequency of such switch not opening at such landing.

The maintenance messages of paragraphs (M)–(R) may include a first portion directing that the car door closed switch be cleaned or adjusted, if desired; otherwise, the maintenance messages need not include the first portion:

(M) determining that the car door closed switch fails to close when the car door is closed (Parameter Nos. 9 and 10, FIG. 5), too often, and generating a reason and severity portion of a maintenance message indicative thereof including the frequency of such failures;

(N) determining that the car door closed switch is closed (Parameter No. 9, FIG. 4) when the car door is open (Parameter No. 10, FIG. 1), too often, and generating a reason and severity portion of a maintenance message indicative thereof;

(O) determining that the car door closed switch opens without a door open command (Parameter No. 35, FIG. 6) with the car door fully closed (Parameter No. 34, FIG. 6) at a landing (Parameter No. 15, FIG. 6) too often, and generating a reason and severity portion of a maintenance message indicative thereof including the frequency of such openings;

(P) determining that the car door closed switch opens without a door open command (Parameter No. 35, FIG. 6) with the car door fully closed (Parameter No. 34, FIG. 6) when the car is moving (Parameter No. 15, FIG. 6), too often, and generating a reason and severity portion of a maintenance message indicative thereof including the frequency of such openings;

(Q) determining that, on average the car door closed switch does not close (Parameter No. 13, FIG. 4) until the car door is closed too far (Parameter No. 14, FIG. 4), and generating a reason and severity portion of a maintenance message indicative thereof and directing that the car door closed switch be moved correspondingly;

(R) determining that the car door closed switch has operated (Parameter No. 9) a number of times that exceeds a related periodic inspection threshold, and generating a reason and severity portion of a maintenance message indicative thereof including the excess over the threshold.

The maintenance messages of paragraphs (S)–(Y) may include a first portion directing that the related car door track or car door sill be cleaned or adjusted, if desired; otherwise, the maintenance messages of paragraphs (S)–(Y) need not include the first portion.

(S) determining that the car door does not open fully at a final opening speed above a threshold speed (Parameter No. 16, which is a combination of Parameter Nos. 24 and 25, FIG. 15) too often, at an excessive number of landings, and generating a reason and severity portion of a maintenance message indicative thereof including at least one of (1) the frequency of not opening fully and (2) the average amount by which the car door does not open fully;

(T) determining that the car door does not close fully at a final closing speed above a threshold speed (Parameter No. 17, which is a combination of Parameter Nos. 28 and 30, FIG. 15), too often, at an excessive number of landings, and generating a reason and severity portion of a maintenance message indicative thereof including at least one of (1) the frequency of not closing fully and (2) the average amount by which the car door does not close fully;

(U) determining, from the average time required to open (Parameter No. 18, FIG. 7) or close (Parameter No. 19, FIG. 8) the car door at low constant door motor current (Parameter No. 31, FIG. 7, FIG. 8), being too high at a given landing, for an excessive number of landings, that there is excessive friction when opening or closing the car door, respectively, and generating a reason and severity portion of a respectively corresponding maintenance message indicative thereof including the ratio of (1) such average time required for the car door to open or close, respectively, to (2) a proper time for doing so;

(V) determining, from the average distance that the car door moves in the closing direction after door motor current ceases when the car door has opened (Parameter No. 20, FIG. 9), at an excessive number of landings, that there is excessive resistance to holding the car door open, and generating a reason and severity portion of a maintenance message indicative thereof including at least one of (1) said average distance and (2) a proper open position for the car door;

(W) determining, from the average distance that the car door moves in the opening direction after door motor current ceases when the car door has closed (Parameter No. 21, FIG. 9), at an excessive number of landings, that there is excessive resistance to holding the car door closed, and generating a reason and severity portion of a maintenance message indicative thereof including at least one of (1) said average amount and (2) a proper closed position for the car door;

(X) determining, from the car door slowing down while opening (Parameter No. 22, FIGS. 11 and 12) or closing (Parameter No. 23, FIG. 14), too often, at an excessive number of landings, that there is an excessive impediment to car door movement, and generating a reason and severity portion of a respectively corresponding maintenance message indicative thereof including at least one of (1) the maximal amount of slowing down, (2) the frequency of encountering excessive impediments to car door movement, and (3) the car door position where the maximal amount of slowing down occurred;

(Y) determining that the number of car door operations (Parameter No. 11) has exceeded a related periodic inspection threshold, and generating a reason and severity portion of a maintenance message indicative thereof including an indication of the excess.

The maintenance messages of paragraphs (Z)–(EE) may include a first portion that directs cleaning or adjusting the door track or door sill at any given landing door, if desired; otherwise, the maintenance messages of paragraphs (Z)–(EE) need not include the first portion:

(Z) determining that the car door does not open fully (Parameter No. 24, FIG. 15; Parameter No. 16) at a final opening speed above a threshold speed (Parameter No. 25, FIG. 15), too often, at a small number of landings, and generating a reason and severity portion of a maintenance message indicative thereof including at least one of (1) the frequency of not opening fully at any landing and (2) the average error in the open position at said any landing;

(AA) determining that the car door does not close fully (Parameter No. 28, FIG. 15: Parameter No. 17) at a final closing speed above a threshold speed (Parameter No. 30, FIG. 15), too often, at a small number of landings, and generating a reason and severity portion of a maintenance message indicative thereof including at least one of (1) the frequency of not closing fully at any landing and, (2) the average error in the closed position at said any landing;

(BB) determining, from the average time required to open (Parameter No. 18, FIG. 7) or close (Parameter No. 19, FIG. 8) the car door with constant door motor current (Parameter No. 31, FIG. 7, FIG. 8) being too high, at any given landing, at a small number of landings, that there is excessive friction when opening or closing, respectively, said given landing door and generating a reason and severity portion of a respectively corresponding maintenance message indicative thereof including a ratio of (1) the actual average time for opening or closing, respectively, said given landing door to (2) a respective proper time;

(CC) determining, from the average distance that the car door moves in the closing direction after door motor current ceases when the car door has been opened (Parameter No. 20, FIG. 9) at any given landing, at a small number of landings, that there is excessive resistance to holding the given landing door open, and generating a reason and severity portion of a maintenance message indicative thereof including the difference between (1) said average distance and (2) a proper position for said given landing door;

(DD) determining, from the car door slowing down while opening (Parameter No. 22, FIG. 11) or closing (Parameter No. 23, FIG. 14) at a given landing, too often, for a small number of landings, that there is an excessive impediment to movement of said given landing door and generating a reason and severity portion of a respectively corresponding maintenance message indicative thereof including the frequency of encountering excessive impediments to movement of said given landing door;

(EE) determining that the total number of operations of a given landing door (Parameter No. 8) exceeds a related periodic inspection threshold and generating a reason and severity portion of a maintenance message indicative thereof including the excess of said operations over said threshold.

The maintenance messages of paragraphs (FF) and (GG) may include a first portion that directs adjustment of the door-driving flexible traction loop (such as a belt) be adjusted, if desired; otherwise, the maintenance messages of paragraphs (FF) and (GG) need not include the first portion:

(FF) determining from an excessive average open position of the car door (Parameter No. 24, FIG. 15), when opened with a constant low door motor current (Parameter No. 31, FIGS. 7 and 8) with no landing door coupled thereto, that the door-driving flexible traction loop (such as a belt) is loose, and generating a reason and severity portion of a maintenance message indicative thereof including the amount of such excess;

(GG) determining that the number of door operations (Parameter No. 11) exceeds a related periodic inspection threshold and generating a reason and severity portion of a maintenance message indicative thereof.

The maintenance messages of paragraphs (HH)–(MM) may include a first portion directing that the door motor or door controller mechanism be adjusted, if desired; otherwise, the maintenance messages of paragraphs (HH)–(MM) need not include the first portion:

(HH) determining that the car door does not open fully (Parameter No. 24, FIG. 15), at a final opening speed above a threshold speed (Parameter No. 25, FIG. 15), too often, at any given landing, for an excessive number of landings, and generating reason and severity portions of a maintenance message indicative thereof including at least one of (1) the frequency of the car door not opening fully and (2) the average error of the open position;

(II) determining that the speed of the car door as it becomes fully open (Parameter No. 25, FIG. 15) or fully closed (Parameter No. 30, FIG. 15) is too frequently excessive at an excessive number of said landings, and generating a reason and severity portion of a respectively corresponding maintenance message indicative thereof including at least one of (1) the frequency of excessive speed and (2) the average of the related excessive speed;

(JJ) determining that the speed of the car door as the landing door lock switch opens (Parameter No. 26, FIG. 1) or closes (Parameter No. 7, FIG. 3) is too frequently excessive or deficient and generating a respectively corresponding reason and severity portion of a maintenance message indicative thereof including the frequency of occurrence of the related excessive or deficient speed;

(KK) determining that the car door too frequently does not fully close (Parameter No. 28, FIG. 15) at a final closing speed above a threshold speed (Parameter No. 30, FIG. 15), at an excessive number of landings, and generating a reason and severity portion of a maintenance message indicative thereof including at least one of (1) the frequency of not fully closing and (2) the average related closed position error;

(LL) determining that the time required to open (Parameter No. 32, FIG. 7) or close (Parameter No. 33, FIG. 8) the car door normally (Parameter No. 31, FIGS. 7 and 8) is not stable at an excessive number of landings and generating a reason and severity portion of a respectively corresponding maintenance message indicative thereof including the variation in respective opening or closing time;

(MM) determining from the position of the car door (Parameter No. 34, FIG. 6) when it opens without command (Parameter No. 35, FIG. 6), that the door controller has opened the car door without command too often, and generating a reason and severity portion of a maintenance message indicative thereof including the frequency thereof.

The maintenance messages of paragraphs (NN) and (OO) may include a first portion directing that the door position encoder be adjusted or replaced, if desired; otherwise, the maintenance messages of paragraphs (NN) and (OO) need not include such portion:

(NN) determining that the position indicated by the door position encoder when the car door closed sensor opens (Feature No. 36, FIG. 10) differs excessively from a true door closed position (Parameter No. 37, FIG. 10), too often, and generating a reason and severity portion of a maintenance message indicative thereof including at least one of (1) the frequency thereof and (2) an instruction to also check the car door closed sensor;

(OO) determining that the number of car door operations (Parameter No. 11) exceeds a related periodic inspection threshold, and generating a reason and severity portion of a maintenance message indicative thereof including the excess over the threshold.

The maintenance messages of paragraphs (PP)–(SS) may include a first portion that directs adjustment or replacement of the between-door safety device, if desired; otherwise, the maintenance messages of paragraphs (PP)–(SS) need not include such portion:

(PP) determining that the frequency of operation of the between-door safety device (Parameter No. 38, FIG. 16), when passengers are unlikely to be interacting with the door (Parameter No. 39, FIG. 17), is excessive, and generating a reason and severity portion of a maintenance message indicative thereof including said frequency;

(QQ) determining that the frequency of operation of the between-door safety device at any given landing (Parameter No. 38, FIG. 16), when passengers are likely to be interacting with the door (Parameter No. 39, FIG. 17), is deficient, for an excessive number of landings, and generating a reason and severity portion of a maintenance message indicative thereof including said frequency;

(RR) determining that the between-door safety device remains operated for an excessive period of time (Parameter No. 42, FIG. 17), and generating a reason and severity portion of a maintenance message indicative thereof;

(SS) determining that the between-door safety device has operated (Parameter No. 38, FIG. 17) in excess of a related periodic inspection threshold number of times, and generating a reason and severity portion of a maintenance message indicative thereof including said excess.

The maintenance messages of paragraphs (TT)–(AAA) may include a first portion directing adjustment or replacement of the related button, if desired; otherwise, the maintenance messages of paragraphs (TT)–(AAA) need not include the first portion:

(TT) determining that the frequency of a door open or close button switch being operated (Parameter No. 43, FIGS. 18 and 19), when passenger interaction with the door is unlikely (Parameter No. 39, FIG. 16), is excessive, and generating a reason and severity portion of a respectively corresponding maintenance message indicative thereof including the frequency thereof;

(UU) determining that door open button activity is lower than expected (Parameter No. 46, FIG. 18), during a period in which there are at least a threshold number of door reversals (Parameter No. 47), and generating a reason and severity portion of a maintenance message indicative thereof;

(VV) determining that door close button activity is lower than expected (Parameter No. 48, FIG. 19), and generating a reason and severity portion of a maintenance message indicative thereof;

(WW) determining that the average duration of a door open or close button being operated (Parameter No. 44, FIGS. 18 and 19), over the last five or ten operations, is too long and generating a reason and severity portion of a respectively corresponding maintenance message indicative thereof including said average duration;

(XX) determining that the total number of times a door open or close button has been operated (Parameter No. 46, FIG. 18; Parameter No. 48, FIG. 19) exceeds a related periodic inspection threshold, and generating a reason and severity portion of a respectively corresponding maintenance message indicative thereof including the excess over the related threshold.

(YY) determining that usage of a landing or car call button (Parameter No. 43, FIGS. 20 and 21) per run to the corresponding landing is lower than expected, and generating a reason and severity portion of a respectively corresponding maintenance message indicative thereof including the frequency of use and the related landing;

(ZZ) determining that the average duration of a landing or car call button being operated (Parameter No. 44, FIGS. 20 and 21), over the last five or ten operations, is too long, and generating reason and severity portions of a respectively corresponding maintenance message indicative thereof including said average duration and the related landing;

(AAA) determining that the number of times that a landing or car call button has been operated (Parameter No. 45, FIGS. 20 and 21) exceeds a related periodic inspection threshold, and generating a reason and severity portion of a respectively corresponding maintenance message indicative thereof including the excess and the related landing.

The maintenance messages of paragraphs (BBB) and (CCC) may also include a first portion directing replacement of the related call button light, if desired; otherwise, the maintenance messages of paragraphs (BBB) and (CCC) need not include the first portion:

(BBB) determining that the ratio of (1) the number of landing or car call button operations for a landing to (2) the number of related stops (Feature No. 43, FIGS. 20 and 21) for that landing is excessive, and generating a reason and severity portion of a respectively corresponding maintenance message indicative thereof including the related landing;

(CCC) determining that either (1) the number of operations of a landing or car call button (Parameter No. 45, FIGS. 22 and 23) or (2) the total time a call button has been operated (Parameter No. 44, FIGS. 22 and 23), is excessive, and generating a reason and severity portion of a respectively corresponding maintenance message indicative thereof including the excess and the related landing.

The maintenance messages of paragraphs (DDD) and (EEE) may include a first portion directing adjustment or replacement of the car rail guides, if desired; otherwise, the maintenance messages of paragraphs (DDD) and (EEE) need not include the first portion:

(DDD) determining, from the position of the car door when the landing door lock at any given landing opens (Parameter No. 1, FIG. 1), varying excessively, at an excessive number of landings, that the position of landing door lock operation is inconsistent and that there is excessive side-to-side car displacement, and generating reason and severity portion of a maintenance message indicative thereof including said variation and said given landing;

(EEE) determining that the total distance traveled by the car (Parameter No. 49, FIG. 25) exceeds a related periodic inspection threshold, and generating a reason and severity portion of a maintenance message indicative thereof including the excess over the threshold.

The maintenance message of paragraph (FFF) may include a first portion directing adjustment of the side-to-side clearance of the car guide rails, if desired; otherwise, the maintenance message of paragraph (FFF) need not include the first portion:

(FFF) determining, from the position of the car door when the landing door lock at any given landing opens (Parameter No. 1, FIG. 1) varying excessively, at a small number of landings, that the position of landing door lock operation is inconsistent, and generating a reason and severity portion of a maintenance message indicative thereof including said variation and said given landing.

The aforementioned patent application is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of auditing the operation of an elevator system serving a plurality of landings and .having a car and at least one of (a) a car door with (i) a door closed sensor, (ii) a track, (iii) a sill, (iv) a motor driving the door through a traction loop, (v) a door controller mechanism, and (vi) a position encoder (b) a landing door with (i) a door lock and door lock switch, (ii) a track, and (iii) a sill, (c) a door vane interacting with rollers or guides to cause a corresponding landing door to move in response to movement of said car door, (d) a between-door safety device, (e) a door button switch selected from a door open button and a door close button, (f) a call button switch with a light, related to a given landing, selected from car call buttons and landing call buttons, and (g) having (i) a pair of car guide rails and (ii) a car juxtapositioned with said rails by (iii) car rail guides, which method comprises performing at least one of the following steps (A)–(FFF):

(A) determining, from a landing door lock opening when the car door is either too far open or not open enough, too often, at an excessive number of landings, that a door vane is mispositioned, and generating a respectively corresponding maintenance message indicative thereof including directing that the related door vane be moved accordingly;

(B) determining that a landing door lock switch fails to close when the landing door closes, too often, at an excessive number of landings, and generating a maintenance message indicative thereof including the frequency of such failures;

(C) determining that a landing door lock switch opens without a door open command, too often, at an excessive number of landings, and generating a maintenance message indicative thereof including the frequency of such openings;

(D) determining that a landing door lock switch is not open when the related landing door is open, too often, at an excessive number of landings, and generating a maintenance message indicative thereof;

(E) determining, from a landing door lock opening when the car door is either too far open or not open enough, and there is no maintenance message of paragraphs (A)–(D) to adjust a door vane, too often, at a small number of landings, that the door lock alignment is wrong, and generating a reason and severity portion of a respectively corresponding maintenance message indicative thereof directing that the door lock at such landing be moved a corresponding amount in an appropriate direction;

(F) determining that the landing door lock switch at a landing fails to close when the landing door closes, too often, and generating a reason and severity portion of a maintenance message indicative thereof including the frequency of such failure;

(G) determining that the landing door lock switch opens at a landing without a door open command, too often, when there is no maintenance message of paragraphs. (A)–(D) to adjust a door vane, and generating a maintenance message indicative thereof including the frequency of such openings;

(H) determining, from a landing door lock switch rebounding from closed to open when the door closes with a high final closing speed, insufficiently often, when there is no maintenance message of paragraphs (A)–(D) to adjust a door vane, that the door lock has excessive friction, and generating a maintenance message indicative thereof including an indication of the deficient number of rebounds;

(I) determining that a landing door has operated more times than a related periodic inspection threshold number of times, and generating a maintenance message indicative thereof including the excess of such times over the threshold;

(J) determining, from a landing door lock switch rebounding from closed to open when the door closes with a low final closing speed and there is no maintenance message of paragraphs (A)–(D) to adjust a door vane, too often, that cleaning of the switch is required, and generating a maintenance message indicative thereof including the frequency of such rebounds;

(K) determining that the total number of landing door lock switch operations exceeds a related threshold, and generating a maintenance message indicative thereof including an indication of the number of such operations;

(L) determining that a landing door lock switch is not open when the related landing door is open, for a small number of landings, and generating a maintenance message indicative thereof including the frequency of such switch not opening at such landing;

(M) determining that the car door closed switch fails to close when the car door is closed, too often, and generating a maintenance message indicative thereof including the frequency of such failures;

(N) determining that the car door-closed switch is closed when the car door is open, too often, and generating a maintenance message indicative thereof;

(O) determining that the car door closed switch opens without a door open command with the car door fully closed at a landing, too often, and generating a maintenance message indicative thereof including the frequency of such openings;

(P) determining that the car door closed switch opens without a door open command with the car door fully closed when the car is moving, too often, and generating a maintenance message indicative thereof including the frequency of such openings;

(Q) determining that, on average, the car door closed switch does not close until the car door is closed too far, and generating a maintenance message indicative thereof and directing that the car door closed switch be moved correspondingly;

(R) determining that the car door closed switch has operated a number of times that exceeds a related periodic inspection threshold, and generating a maintenance message indicative thereof including the excess over the threshold;

(S) determining that the car door does not open fully at a final opening speed above a threshold speed, too often, at an excessive number of landings, and generating a maintenance message indicative thereof including at least one of (1) the frequency of not opening fully and (2) the average amount by which the car door does not open fully;

(T) determining that the car door does not close fully at a final closing speed above a threshold speed, too often, at an excessive number of landings, and generating a maintenance message indicative thereof including at least one of (1) the frequency of not closing fully and (2) the average amount by which the car door does not close fully;

(U) determining, from the average time required to open or close the car door at low constant door motor current, being too high at a given landing, for an excessive number of landings, that there is excessive friction when opening or closing the car door, respectively, and generating a respectively corresponding maintenance message indicative thereof including the ratio of (1) such average time required for the car door to open or close, respectively, to (2) a proper time for doing so;

(V) determining, from the average distance that the car door moves in the closing direction after door motor current ceases when the car door has opened, at an excessive number of landings, that there is excessive resistance to holding the car door open, and generating a maintenance message indicative thereof including at least one of (1) said average distance and (2) a proper open position for the car door;

(W) determining, from the average distance that the car door moves in the opening direction after door motor current ceases when the car door has closed, at an excessive number of landings, that there is excessive resistance to holding the car door closed, and generating a maintenance message indicative thereof including at least one of (1) said average distance and (2) a proper closed position for the car door;

(X) determining, from the car door slowing down while opening or closing, too often, at an excessive number of landings, that there is an excessive impediment to car door movement, and generating a respectively corresponding maintenance message indicative thereof including at least one of (1) the maximal amount of slowing down, (2) the frequency of encountering excessive impediments to car door movement, and (3) the car door position where the maximal amount of slowing down occurred;

(Y) determining that the number of car door operations has exceeded a related periodic inspection threshold, and generating a maintenance message indicative thereof including an indication of the excess;

(Z) determining that the car door does not open fully at a final opening speed above a threshold speed, too often, at a small number of landings, and generating a maintenance message indicative thereof including at least one of (1) the frequency of not opening fully at any landing and (2) the average error in the open position at said any landing;

(AA) determining that the car door does not close fully at a final closing speed above a threshold speed, too often, at a small number of landings, and generating a maintenance message indicative thereof including at least one of (1) the frequency of not closing fully at any landing and (2) the average error in the closed position at said any landing;

(BB) determining, from the average time required to open or close the car door with constant door motor current being too high, at any given landing, at a small number of landings, that there is excessive friction when opening or closing, respectively, said given landing door and generating a respectively corresponding maintenance message indicative thereof including a ratio of (1) the actual average time for opening or closing, respectively, said given landing door to (2) a respective proper time;

(CC) determining, from the average distance that the car door moves in the closing direction after door motor current ceases when the car door has been opened at any given landing, at a small number of landings, that there is excessive resistance to holding the given landing door open, and generating a maintenance message indicative thereof including the difference between (1) said average distance and (2) a proper position for said given landing door;

(DD) determining, from the car door slowing down while opening or closing at a given landing, too often, for a small number of landings, that there is an excessive impediment to movement of said given landing door and generating a respectively corresponding maintenance message indicative thereof including the frequency of encountering excessive impediments to movement of said given landing door;

(EE) determining that the total number of operations of a given landing door exceeds a related periodic inspection threshold and generating a maintenance message indicative thereof including the excess of said operations over said threshold;

(FF) determining from an excessive average open position of the car door, when opened with a constant low door motor current with no landing door coupled thereto, that the door-driving flexible traction loop is loose, and generating a maintenance message indicative thereof including the amount of such excess;

(GG) determining that the number of door operations exceeds a related periodic inspection threshold and generating a maintenance message indicative thereof;

(HH) determining that the car door does not open fully, at a high final opening speed above a threshold speed, too often, at any given landing, for an excessive number of landings, and generating a maintenance message indicative thereof including at least one of (1) the frequency of the car door not opening fully and (2) the average error of the open position;

(II) determining that the speed of the car door as it becomes fully open or fully closed is too frequently excessive at an excessive number of said landings, and generating a respectively corresponding maintenance message indicative thereof including at least one of (1) the frequency of excessive speed and (2) the average of the related excessive speed;

(JJ) determining that the speed of the car door as the landing door lock switch opens or closes is too frequently excessive or deficient and generating a respectively corresponding maintenance message indicative thereof including the frequency of occurrence of the related excessive or deficient speed;

(KK) determining that the car door too frequently does not fully close at a final closing speed above a threshold speed, at an excessive number of landings, and generating a maintenance message indicative thereof including at least one of (1) the frequency of not fully closing and (2) the average related closed position error;

(LL) determining that the time required to open or close the car door normally is not stable at an excessive number of landings, and generating a respectively corresponding maintenance message indicative thereof including the variation in respective opening or closing time;

(MM) determining, from the position of the car door when it opens without command, that the door controller has opened the car door without command too often, and generating a maintenance message indicative thereof including the frequency thereof;

(NN) determining that the position indicated by the door position encoder when the car door closed sensor opens differs excessively from a true door closed position, too often, and generating a maintenance message indicative thereof including at least one of (1) the frequency thereof and (2) an instruction to also check the car door closed sensor;

(OO) determining that the number of car door operations exceeds a related periodic inspection threshold, and generating a maintenance message indicative thereof including the excess over the threshold;

(PP) determining that the frequency of operation of the between-door safety device, when passengers are unlikely to be interacting with the door, is excessive, and generating a maintenance message indicative thereof including said frequency;

(QQ) determining that the frequency of operation of the between-door safety device at any given landing, when passengers are likely to be interacting with the door, is deficient, for an excessive number of landings, and generating a maintenance message indicative thereof including said frequency;

(RR) determining that the between-door safety device remains operated for an excessive period of time, and generating a maintenance message indicative thereof;

(SS) determining that the between-door safety devices has operated in excess of a related periodic inspection threshold number of times, and generating a maintenance message indicative thereof including said excess;

(TT) determining that the frequency of a door button switch being operated, when passenger interaction with the door is unlikely, is excessive, and generating a respectively corresponding maintenance message indicative thereof including the frequency thereof;

(UU) determining that door open button activity is lower than expected during a period in which there are at least a threshold number of door reversals, and generating a maintenance message indicative thereof;

(VV) determining that door close button activity is lower than expected, and generating a maintenance message indicative thereof;

(WW) determining that the average duration of a door button being operated, over a last given number of operations, is too long, and generating a respectively corresponding maintenance message indicative thereof including said average duration;

(XX) determining that the total number of times a door button has been operated exceeds a related periodic inspection threshold, and generating a respectively corresponding maintenance message indicative thereof including the excess over the related threshold;

(YY) determining that call button usage per run to the corresponding landing is lower than expected, and generating a respectively corresponding maintenance message indicative thereof including the frequency of use and the related landing;

(ZZ) determining that the average duration of a call button being operated, over a last given number of operations, is too long, and generating a respectively corresponding maintenance message indicative thereof including said average duration and the related landing;

(AAA) determining that the number of times that a call button has been operated exceeds a related periodic inspection threshold, and generating a respectively corresponding maintenance message indicative thereof including the excess and the related landing;

(BBB) determining that the ratio of (1) the number of call button operations for a landing to (2) the number of related stops for that landing is excessive, and generating a respectively corresponding maintenance message indicative thereof including the related landing;

(CCC) determining that either (1) the number of operations of a call button or (2) the total time a call button has been operated, is excessive, and generating a respectively corresponding maintenance message indicative thereof including the excess and the related landing;

(DDD) determining, from the position of the car door, when the landing door lock at any given landing opens, varying excessively, at an excessive number of landings, that the position of landing door lock operation is inconsistent and that there is excessive side-to-side car displacement, and generating a maintenance message indicative thereof, including said variation and said given landing;

(EEE) determining that the total distance traveled by the car exceeds a related periodic inspection threshold, and generating a maintenance message indicative thereof including the excess over the threshold; and (FFF) determining, from the position of the car door when the landing door lock at any given landing opens varying excessively, at a small number of landings, that the position of landing door lock operation is inconsistent, and generating a maintenance message indicative thereof including said variation and said given landing.

2. A method of auditing the operation of an elevator system serving a plurality of landings and having a car and at least one of (i) a car door (ii) a landing door with a door lock, and (iii) a door vane interacting with rollers or guides to cause a corresponding landing door to move in response to movement of said car door, which method comprises performing at least one of the following steps (A)–(L):

(A) determining, from a landing door lock opening when the car door is either too far open or not open enough, too often, at an excessive number of landings, that a door vane is mispositioned, and generating a respectively corresponding maintenance message indicative thereof including directing that the related door vane be moved accordingly;

(B) determining that a landing door lock switch fails to close when the landing door closes, too often, at an excessive number of landings, and generating a maintenance message indicative thereof including the frequency of such failures;

(C) determining that a landing door lock switch opens without a door open command, too often, at an excessive number of landings and generating a maintenance message indicative thereof including the frequency of such openings;

(D) determining that a landing door lock switch is not open when the related landing door is open, too often, at an excessive number of landings, and generating a maintenance message indicative thereof;

(E) determining, from a landing door lock opening, when the car door is either too far open or not open enough, when there is no maintenance message of paragraphs (A)–(D) to adjust a door vane, too often, at a small number of landings, that the door lock alignment is wrong, and generating a respectively corresponding maintenance message indicative thereof and directing that the door lock at such landing be moved a corresponding amount in an appropriate direction;

(F) determining that the landing door lock switch at a landing fails to close when the landing door closes, too often, and generating a maintenance message indicative thereof including the frequency of such failure;

(G) determining that the landing door lock switch opens at a landing without a door open command, too often, when there is no maintenance message of paragraphs (A)–(D) to adjust a door vane, and generating a maintenance message indicative thereof including the frequency of such openings;

(H) determining, from a landing door lock switch rebounding from closed to open when the door closes with a high final closing speed, insufficiently often, when there is no maintenance message of paragraphs (A)–(D) to adjust a door vane, that the door lock has excessive friction and generating a maintenance message indicative thereof including an indication of the deficient number of rebounds;

(I) determining that a landing door has operated more times than a related periodic inspection threshold number of times and generating a maintenance message indicative thereof including the excess of such times over the threshold;

(J) determining, from a landing door lock switch rebounding from closed to open when the door closes with a low final closing speed and there is no maintenance message of paragraphs (A)–(D) to adjust a door vane, too often, that cleaning of the switch is required and generating a maintenance message indicative thereof including the frequency of such rebounds;

(K) determining that the total number of landing door lock switch operations exceeds a related threshold and generating a maintenance message indicative thereof including an indication of the number of such operations; and (L) determining that a landing door lock switch is not open when the related landing door is open, for a small number of landings, and generating a maintenance message indicative thereof including the frequency of such switch not opening at such landing.

3. A method according to claim 2 wherein:

said maintenance messages of paragraphs (A)–(D) also direct that the position of the related door vane be adjusted.

4. A method according to claim 2 wherein:

said maintenance messages of paragraphs (E)–(G) also direct that the alignment of the related landing door lock be adjusted.

5. A method according to claim 2 wherein:

said maintenance messages of paragraphs (H)–(L) also direct that the related landing door lock be cleaned or adjusted.

6. A method of auditing the operation of an elevator system serving a plurality of landings and having (i) a car door with (ii) a car door switch, which method comprises performing at least one of the following steps (A)–(F);

(A) determining that the car door closed switch fails to close when the car door is closed, too often, and generating a maintenance message indicative thereof including the frequency of such failures;

(B) determining that the car door switch is closed when the car door is open, too often, and generating a maintenance message indicative thereof;

(C) determining that the car door closed switch opens without a door open command with the car door,fully closed at a landing, too often, and generating a maintenance message indicative thereof including the frequency of such openings;

(D) determining that the car door closed switch opens without a door open command with the car door fully closed when the car is moving, too often, and generating a maintenance message indicative thereof including the frequency of such openings;

(E) determining that, on average, the car door closed switch does not close until the car door is closed too far, and generating a maintenance message indicative thereof and directing that the car door closed switch be moved correspondingly; and (F) determining that the car door closed switch has operated a number of times that exceeds a related periodic inspection threshold, and generating a maintenance message indicative thereof including the excess over the threshold.

7. A method according to claim 6 wherein:

said maintenance messages also direct that the car door closed switch be cleaned or adjusted.

8. A method of auditing the operation of an elevator system having at least one door system component selected from (i) a car door track and (ii) a car door sill, which method comprises performing at least one of the following steps (A)–(G):

(A) determining that the car door does not open fully at a final opening speed above a threshold speed, too often, at an excessive number of landings, and generating a maintenance message indicative thereof including at least one of (1) the frequency of not opening fully and (2) the average amount by which the car door does not open fully;

(B) determining that the car door does not close fully at a final closing speed above a threshold speed, too often, at an excessive number of landings, and generating a maintenance message indicative thereof including at least one of (1) the frequency of not closing fully and (2) the average amount by which the car door does not close fully;

(C) determining, from the average time required to open or close the car door at low constant door motor current, being too high at a given landing, for an excessive number of landings, that there is excessive friction when opening or closing the car door, respectively, and generating a respectively corresponding maintenance message indicative thereof including the ratio of (1) such average time required for the car door to open or close, respectively, to (2) a proper time for doing so;

(D) determining, from the average distance that the car door moves in the closing direction after door motor current ceases when the car door has opened, at an excessive number of landings, that there is excessive resistance to holding the car door open, and generating a maintenance message indicative thereof including at least one of (1) said average distance and (2) a proper open position for the car door;

(E) determining, from the average distance that the car door moves in the opening direction after door motor current ceases when the car door has closed, at an excessive number of landings, that there is excessive resistance to holding the car door closed, and generating a maintenance message indicative thereof including at least one of (1) said average distance and (2) a proper closed position for the car door;

(F) determining, from the car door slowing down while opening or closing, too often, at an excessive number of landings, that there is an excessive impediment to car door movement, and generating a respectively corresponding maintenance message indicative thereof including at least one of (1) the maximal amount of slowing down, (2) the frequency of encountering excessive impediments to car door movement, and (3) the car door position where the maximal amount of slowing down occurred; and (G) determining that the number of car door operations has exceeded a related periodic inspection threshold, and generating a maintenance message indicative thereof including an indication of the excess.

9. A method according to claim 8 wherein:

said maintenance messages also direct that the related car door track or car door sill be cleaned or adjusted.

10. A method auditing the operation of an elevator door system having at least one door system component selected from (i) a landing door track and (ii) a landing door sill, which method comprises performing at least one of the following steps (A)–(H):

(A) determining that the car door does not open fully at a final opening speed above a threshold speed, too often, at a small number of landings, and generating a maintenance message indicative thereof including at least one of (1) the frequency of not opening fully at any landing and (2) the average error in the open position at said any landing;

(B) determining that the car door does not close fully at a final closing speed above a threshold speed, too often, at a small number of landings, and generating a maintenance message indicative thereof including at least one of (1) the frequency of not closing fully at any landing and (2) the average error in the closed position at said any landing;

(C) determining, from the average time required to open or close the car door with constant door motor current being too high, at any given landing, at a small number of landings, that there is excessive friction when opening or closing, respectively, said given landing door and generating a respectively corresponding maintenance message indicative thereof including a ratio of (1) the actual average time for opening or closing, respectively, said given landing door to (2) a respective proper time.

(D) determining, from average distance that the car door closes after door motor current ceases when the car door has been opened at any given landing, that there is excessive resistance to holding the given landing door open, and generating a maintenance message indicative thereof including the difference between (1) said average amount and (2) a proper position for said given landing door;

(E) determining, from the car door slowing down while opening or closing at a given landing, too often, for a small number of landings, that there is an excessive impediment to movement of said given landing door and generating a respectively corresponding maintenance message indicative thereof including the frequency of encountering excessive impediments to movement of said given landing door; and (F) determining that the total number of operations of a given landing door exceeds a related periodic inspection threshold and generating a maintenance message indicative thereof including the excess of said operations over said threshold.

11. A method according to claim 10 wherein:

said maintenance messages also direct that the door track or door sill related to any said given landing be cleaned or adjusted.

12. A method of auditing an elevator system serving a plurality of floors and having (i) at least one car door driven by a motor through a flexible traction loop and (ii) at least one landing door which can be engaged by a corresponding door vane to be opened thereby, which method comprises performing at least one of the following steps (A), (B):

(A) determining from an excessive average open position of the car door, when opened with a constant low door motor current with no landing door coupled thereto, that the door-driving flexible traction loop is loose, and generating a maintenance message indicative thereof including the amount of such excess; and (B) determining that the number of door operations exceeds a related periodic inspection threshold and generating a maintenance message indicative thereof.

13. A method according to claim 12 wherein:

said maintenance messages also direct that said loop be adjusted.

14. A method of serving an elevator system auditing the operation of a plurality of landings and having (i) at least one elevator car door and (ii) related door motor and door controller mechanism, which method comprises performing at least one of the following steps (A)–(F):

(A) determining that the car door does not open fully, at a final opening speed above a threshold speed, too often, at any given landing, for an excessive number of landings, and generating a maintenance message indicative thereof including at least one of (1) the frequency of the car door not opening fully and (2) the average error of the open position;

(B) determining that the speed of the car door as it becomes fully open or fully closed is too frequently excessive at an excessive number of said landings, and generating a respectively corresponding maintenance message indicative thereof including at least one of (1) the frequency of excessive speed and (2) the average of the related excessive speed;

(C) determining that the speed of the car door as the landing door lock switch opens or closes is too frequently excessive or deficient and generating a respectively corresponding maintenance message indicative thereof including the frequency of occurrence of the related excessive or deficient speed;

(D) determining that the car door too frequently does not fully close at a final closing speed above a threshold speed, at an excessive number of landings, and generating a maintenance message indicative thereof including at least one of (1) the frequency of not fully closing and (2) the average related closed position error;

(E) determining that the time required to open or close the car door normally is not stable at an excessive number of landings, and generating a respectively corresponding maintenance message indicative thereof including the variation in respective opening or closing time; and (F) determining, from the position of the car door when it opens without command, that the door controller has opened the car door without command too often, and generating a maintenance message indicative thereof including the frequency thereof.

15. A method according to claim 14 wherein:

said maintenance messages also direct that the door motor or door controller mechanism be adjusted.

16. A method of auditing operation of an elevator system serving a plurality of landings and having (i) a car door with (ii) a door position encoder and (iii) a door closed sensor, which method comprises performing at least one of the following steps (A), (B):

(A) determining that the position indicated by the door position encoder when the car door closed sensor opens differs excessively from a true door closed position, too often, and generating a maintenance message indicative thereof including at least one of (1) the frequency thereof and (2) an instruction to also check the car door closed sensor; and (B) determining that the number of car door.operations exceeds a related periodic inspection threshold and generating a maintenance message indicative thereof including the excess over the threshold.

17. A method according to claim 16 wherein:

said maintenance messages also direct that the door position encoder be adjusted or replaced.

18. A method of auditing the operation of an elevator system serving a plurality of landings and having a between-door safety device, which method comprises performing at least one of the following steps (A)–(D):

(A) determining that the frequency of operation of the between-door safety device, when passengers are unlikely to be interacting with the door, is excessive, and generating a maintenance message indicative thereof including said frequency;

(B) determining that the frequency of operation of the between-door safety device at any given landing, when passengers are likely to be interacting with the door, is deficient, for an excessive number of landings, and generating a maintenance message indicative thereof including said frequency;

(C) determining that the between-door safety device remains operated for an excessive period of time and generating a maintenance message indicative thereof;

(D) determining that the between-door safety devices has operated in excess of a related periodic inspection threshold number of times and generating a maintenance message indicative thereof including said excess.

19. A method according to claim 18 wherein:

said maintenance messages also direct that the between-door safety device be adjusted or replaced.

20. A method of auditing the operation of an elevator system having a door and at least one of a door open button, a door close button, a call button switch with a light, related to a given landing, selected from car call buttons and landing call buttons, which method comprises performing at least one of the following steps (A) through (J):

(A) determining that the frequency of a door button switch being operated, when passenger interaction with the door is unlikely, is excessive, and generating a respectively corresponding maintenance message indicative thereof including the frequency thereof;

(B) determining that door open button activity is lower than expected during a period in which there are at least a threshold number of door reversals, and generating a maintenance message indicative thereof;

(C) determining that door close button activity is lower than expected and generating a maintenance message indicative thereof;

(D) determining that the average duration of a door button being operated, over a last given number of operations, is too long, and generating a respectively corresponding maintenance message indicative thereof including said average duration;

(E) determining that the total number of times a door button has been operated exceeds a related periodic inspection threshold, and generating a respectively corresponding maintenance message indicative thereof including the excess over the related threshold;

(F) determining that call button usage per run to the corresponding landing is lower than expected, and generating a respectively corresponding maintenance message indicative thereof including the frequency of use and the related landing;

(G) determining that the average duration of a call button being operated, over a last given number of operations, is too long, and generating a respectively corresponding maintenance message indicative thereof including said average duration and the related landing;

(H) determining that the number of times that a call button has been operated exceeds a related periodic inspection threshold, and generating a respectively corresponding maintenance message indicative thereof including the excess and the related landing;

(I) determining that the ratio of (1) the number of call button operations for a landing to (2) the number of related stops for that landing is excessive, and generating a maintenance message indicative thereof including the related landing; and (J) determining that either (1) the number of operations of a call button or (2) the total time a call button has been operated, is excessive, and generating a respectively corresponding maintenance message indicative thereof including the excess and the related landing.

21. A method according to claim 20 wherein:

the maintenance messages of steps (A)–(H) also direct that the related button be adjusted or replaced.

22. A method according to claim 20 wherein:

the maintenance messages of steps (I) and (J) also direct that the related button light be replaced.

23. A method of auditing the operation of an elevator system serving a plurality of landings and having (i) a pair of car guide rails and (ii) a car juxtapositioned with said rails by (iii) car rail guides, which method comprises performing at least one of the following steps (A), (B):

(A) determining, from the position of the car door, when the landing door lock at any given landing opens, varying excessively, at an excessive number of landings, that the position of landing door lock operation is inconsistent and that there is excessive side-to-side car displacement and generating a maintenance message indicative thereof, including said variation and said given landing; and (B) determining that the total distance traveled by the car exceeds a related periodic inspection threshold and generating a maintenance message indicative thereof including the excess over the threshold.

24. A method according to claim 23 wherein:

said maintenance message also directs that the car rail guides be adjusted or replaced.

25. A method of auditing the operation of an elevator system serving a plurality of landings and having (i) a pair of car guide rails and (ii) a car juxtapositioned with said rails by (iii) car rail guides, which method comprises determining, from the position of the car door, when the landing door lock at any given landing opens, varying excessively, at a small number of landings, that the position of landing door lock operation is inconsistent, and generating a maintenance message indicative thereof including said variation and said given landing.

26. A method according to claim 25 wherein:

said maintenance message also directs that the side-to-side clearance of the car guide rails be adjusted.

* * * * *